United States Patent [19]

Shank et al.

[11] 4,354,807

[45] Oct. 19, 1982

[54] COMPRESSOR-EXPANDER OF THE VANE TYPE HAVING CANTED VANE CAVITY

[75] Inventors: Wayne C. Shank, Tucson, Ariz.; Thomas C. Edwards, Cocoa Beach, Fla.

[73] Assignee: The Rovac Corporation, Rockledge, Fla.

[21] Appl. No.: 146,183

[22] Filed: May 2, 1980

Related U.S. Application Data

[63] Continuation-in-part of Ser. No. 858,680, Dec. 8, 1977, abandoned.

[51] Int. Cl.[3] ..... F01C 1/00; F01C 11/00; F01C 21/04; F01C 21/06

[52] U.S. Cl. ..... 418/13; 418/92; 418/94; 418/178; 418/218; 418/219; 418/255; 418/270

[58] Field of Search ..... 418/13, 92, 94, 178, 418/217–219, 228, 229, 255, 270; 62/402

[56] References Cited

U.S. PATENT DOCUMENTS

| | | | |
|---|---|---|---|
| 173,030 | 2/1876 | Lucas | 418/218 |
| 789,586 | 5/1905 | Bickerton | 418/219 |
| 1,114,046 | 10/1914 | Roessler | 418/92 |
| 2,380,886 | 7/1945 | Waldie | 418/219 |
| 2,691,349 | 10/1954 | Cuny | 418/219 |
| 2,968,434 | 1/1961 | Tursky | 418/255 |
| 3,762,841 | 10/1973 | Savikurki | 418/219 |
| 3,913,351 | 10/1975 | Edwards | 62/402 |

FOREIGN PATENT DOCUMENTS

| | | | |
|---|---|---|---|
| 568898 | 1/1933 | Fed. Rep. of Germany | 418/219 |
| 975389 | 10/1950 | France | 418/219 |
| 426928 | 4/1935 | United Kingdom . | |
| 469008 | 1/1937 | United Kingdom . | |
| 485660 | 5/1938 | United Kingdom . | |
| 602180 | 5/1948 | United Kingdom | 418/219 |
| 789532 | 1/1958 | United Kingdom . | |
| 1448808 | 9/1976 | United Kingdom . | |

*Primary Examiner*—John J. Vrablik

*Attorney, Agent, or Firm*—Leydig, Voit, Osann, Mayer & Holt, Ltd.

[57] ABSTRACT

A compressor-expander having a vaned rotor in which the vanes rotate about an axis which is canted with respect to the rotor axis. The housing of the device has a disc-shaped main cavity having adjacent hub recesses which are concentrically spherical. The cavity is in the form of a doubly truncated sphere canted with respect to the shaft axis. The rotor has a central spherical portion for mating with the recesses and includes an integral Saturn-like ring extending to the outer wall of the cavity to divide the cavity into first and second complementary sides of annular wedge shape. The vanes occupy radially extending slots in the rotor and serve to separate each side into successive chambers which vary cyclically in volume as the shaft rotates without requiring the vanes to bodily reciprocate either radially or axially. Each side is provided with inlet and outlet ports. The vanes have laterally projecting shoulders along their lateral edges formed to mate with the respective concave spherical surfaces in the housing. The vanes comprising each pair are interconnected in coplanar relation by a central connector, the central connectors being offset in the axial direction for crossing one another in the hollow of the rotor. The vanes have lateral edges lying in a cylindrical locus and have a thickness which is related to the thickness of the cavity and the angle of cant of the vane axis.

29 Claims, 41 Drawing Figures

"E" OUT
"E" IN
"C" OUT
"C" IN
COMPR. SIDE 61
EXP. SIDE 62
VA
SA
α=15°

EXP. SIDE

COMPR. SIDE 20
161
151
168
162
155
169
192
191
OUTLET
INLET
167
163
177
166
164
169
194
193
165
20
TO INLET PORT OTHER SIDE
TO OUTLET PORT OTHER SIDE

COMPRESSOR-EXPANDER OF THE VANE TYPE HAVING CANTED VANE CAVITY

This is a continuation-in-part of application Ser. No. 858,680 filed Dec. 8, 1977 now abandoned.

Efforts to produce a compressor-expander machine of the canted vane type have extended over at least the past seven decades. Bickerton U.S. Pat. No. 789,586 (1905) shows a rudimentary rotary engine which appears to use the canted vane principle but the drawings are vague and hard to decipher and at least one of his embodiments is clearly inoperative. The patent in any event does not disclose enough to make possible a practical machine. The Schnurle German Pat. No. 568,898 (1930) shows another rudimentary construction but does not have a rotor having a central spherical portion, a ring of trapezoidal section, plural vane pairs or intersecting slots as well as other elements found to be important in the operation of a workable device.

The British patents to Coleman No. 469,008 (1937) and 485,660 (1938) equivalent to French Pat. No. 824,309, while coming a step closer, also fall short of being a practical device for a number of important reasons. The main chamber is of a complex dual concave-convex conical shape. The vanes of the device cannot maintain sealing at the edges due to failure to recognize the geometry required to maintain sealing. No provision is made to prevent severe leakage at the hub. There is no slotted spherical rotor for receiving the vanes, nor are there sectors interconnected by cores at the axial ends of the rotor. The centers of gravity of the forces on the vanes are so far outboard of the rotor support as to prevent operation of the device. Moreover, the device is incapable of either assembly or disassembly.

In Waldie U.S. Pat. No. 2,388,886 (1945), vanes are separate and not tied together in pairs resulting in high friction and impossibility of operation at high speeds, particularly when used for substances other than oil for which the device has been designed. The ring on the rotor is not of trapezoidal section, but is flat sided, resulting in large carry over particularly when handling a gaseous medium. There are no slots penetrating the rotor, nor is the rotor of hollow construction. The vanes are not provided with shoulders to prevent leakage. The patent recites a construction in which the outer peripheral wall has a center which is removed from the center of the rotary shaft, in other words, a non-concentric arrangement, which will not work.

British Mondot Pat. No. 602,180 (1948) is directed exclusively to a rotary engine. The device is distinguished by use of a recessed circular rim on the rotor which is slotted for porting purposes and which work in conjunction with a slotted vane. The recessed rotor rim causes both leakage and adverse carry-over of fluid. The device is limited to a single vane element and the function is destroyed if more than one vane piece is used. The vane extends not to, but beyond, the peripheral wall of the main cavity. The vane does not have the geometry required for sealing of the lateral edges, nor does the vane have laterally projecting shoulders formed to mate with the respective concave spherical surfaces in the housing. The vane piece, as shown, cannot be assembled into the rotor, nor can the rotor-vane "assembly" be assembled into the stator.

The Caillard French Pat. No. 975,389 (1951) shows a device having a single vane which rubs directly upon the peripheral inner wall of the housing to develop inherently high friction limiting device to extremely low speeds. There is no ring of trapezoidal section. The device has a main chamber which is of dual concave-convex conical shape similar to that of Coleman, as contrasted with use of a doubly truncated sphere. The porting areas are inherently very limited. There is no rotor having intersecting slots and which is centrally hollow. The vane edges do not lie in a cylindrical locus or have adequate thickness to create a seal in all vane positions. Nor does the single vane employ laterally projecting shoulders mating with respective concave spherical surfaces in the housing to prevent leakage.

It is, accordingly, an object of the present invention to produce a compressor-expander of the canted vane type which is workable and practical and which overcomes the limitations and inoperativeness of prior designs. By "compressor-expander" is meant a machine which can be utilized either for compressing or expanding a fluid, or both, employing the same basic construction, with the function depending only upon the port location.

It is an object of the invention to provide a compressor-expander of the canted vane type which is highly efficient and smooth in its operation, which has minimum friction and which is easily, or self, lubricated resulting in a construction having a long maintenance-free life. It is a related object to provide a device of the above type which is capable of sustained operation at extremely high rotative speeds and which is therefore ideally suited to use as a supercharger for an internal combustion engine in either automotive or aircraft usage.

Indeed, the construction is particularly well suited for use as as supercharger since, unlike the usual turbo type superchargers used to date, the device has a positive displacement per revolution providing a number of important advantages when direct coupled to an internal combustion engine which also works on the principle of positive displacement.

It is another object of the invention to provide a device of the above type which has inherently low leakage, either externally or from chamber to chamber, and which is capable of operating over a relatively wide pressure range either in the compression or expansion mode thereby making the device capable of use for a wide variety of applications wherever compression or expansion are required. With one side being ported for compression and the other side for expansion, the device is particularly well adapted for use as a refrigeration unit operating on the reverse-Brayton cycle.

It is still another object of the invention to provide a compressor or expander of compact construction, which is made of a relatively small number of simply formed parts, which may be economically fabricated and assembled, and which permits easy disassembly when inspection of maintenance becomes necessary.

Other objects and advantages of the invention will become apparent upon reading the attached detailed description and upon reference to the drawings in which:

FIG. 1 shows a compressor-expander constructed in accordance with the present invention in the form of a vertical section taken along line 1—1 in FIG. 2.

FIG. 1*a* is a partly diagrammatic end view of the device looking along line 1*a*—1*a* in FIG. 1 and showing the connection of heat exchangers.

FIG. 1*b* is a diagram showing the two wedge, shaped sides into which the housing cavity is divided.

Figure 8:
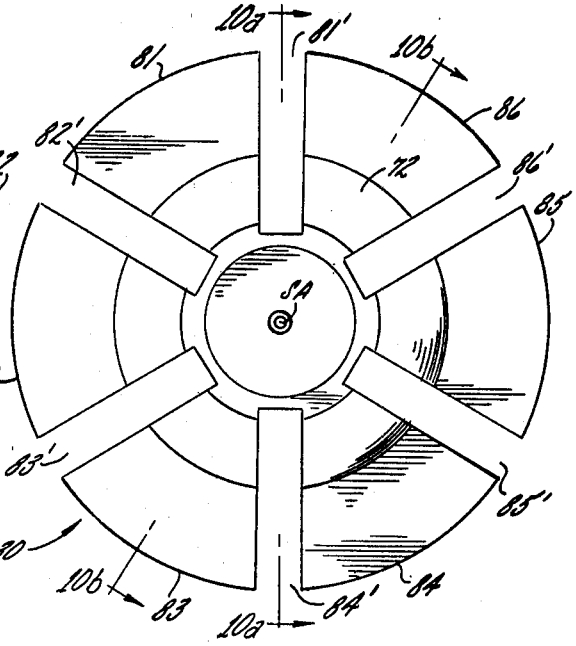
FIG. 8 shows the shaft end view of the rotor body looking along line 8—8 in FIG. 7.
Figure 10A:
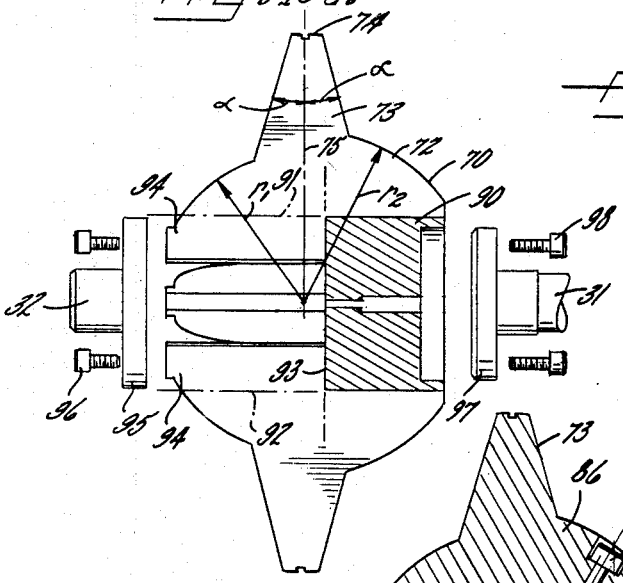

FIG. 10*a* is a section taken through one of the slots in the rotor body looking along line 10*a*—10*a* in FIG. 8 with the stub shafts in exploded relation.

Figure 10B:
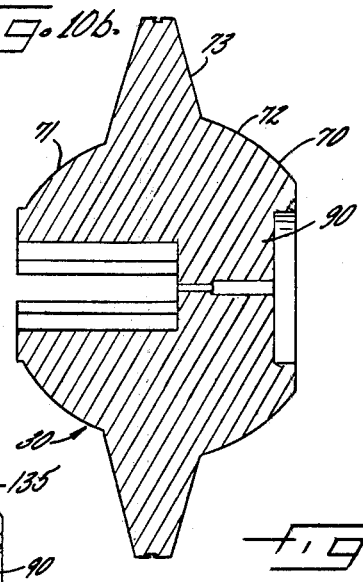

FIG. 10*b* is an adjacent section looking along line 10*b*—10*b* in FIG. 8.

Figure 11:
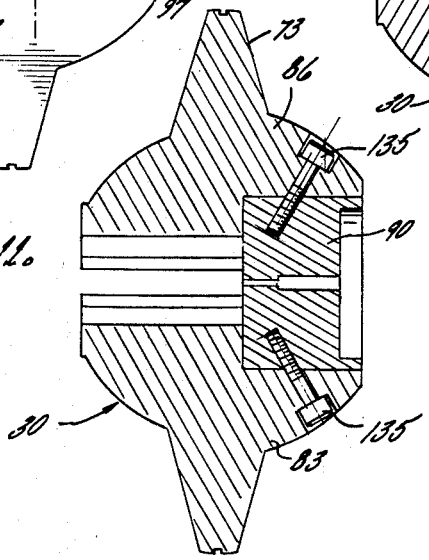

FIG. 11 shows a modified form of rotor body make up of individual sectors held together by screws.

Figure 12:
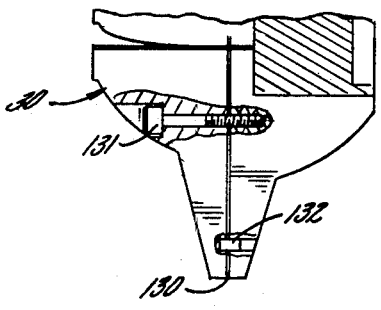

FIG. 12 is a fragmentary section showing the interposition of insulation in the rotor body in a plane perpendicular to the rotor axis.

Figure 13A:
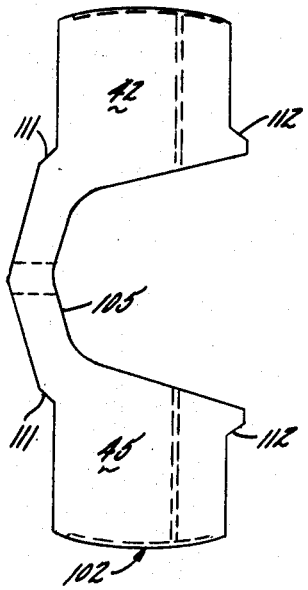
Figure 13B:
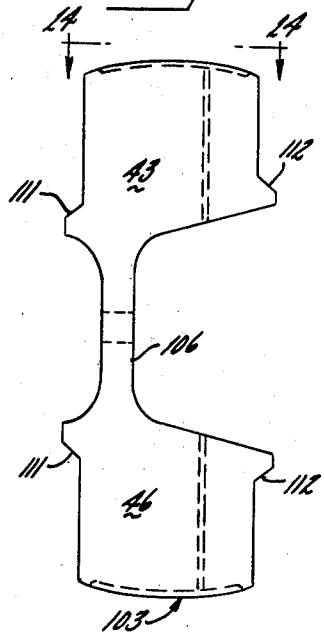
Figure 13C:
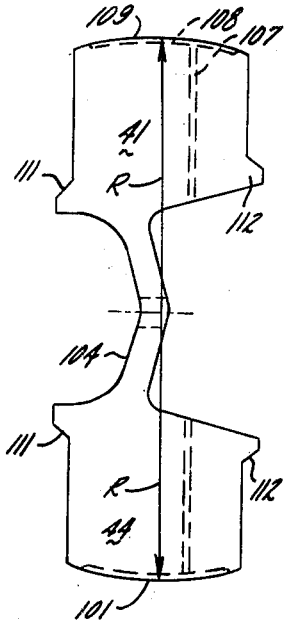

FIGS. 13*a*, 13*b* and 13*c* show the profiles of the three vane plates employed in the present construction.

Figure 14:
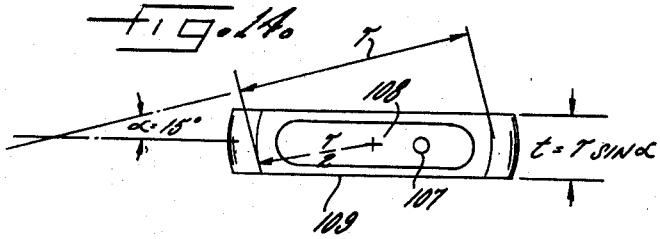

FIG. 14 is an end view of one of the vanes looking along line 14—14 in FIG. 13*b*.

Figure 15:
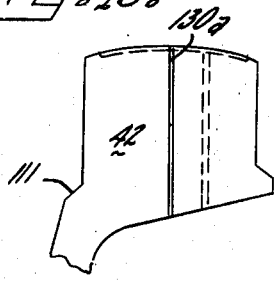

FIG. 15 shows a vane including a layer of insulation along its medial line.

Figure 16:
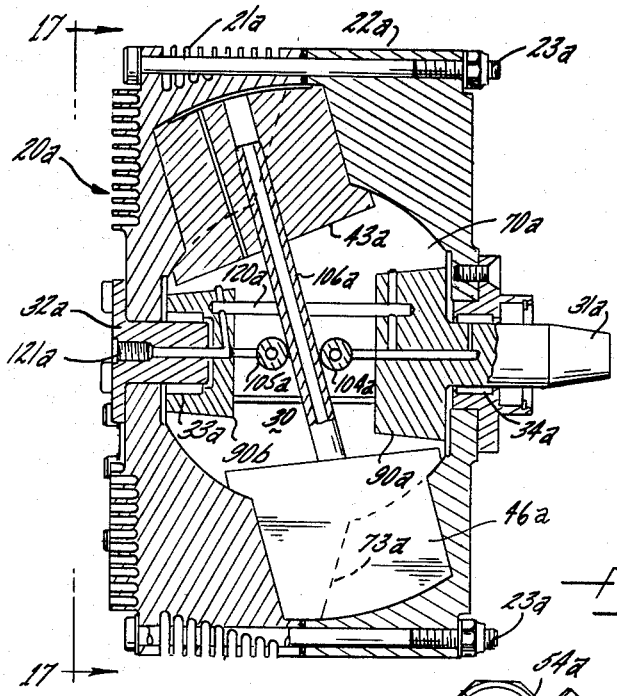

FIG. 16 is an axial section, similar to FIG. 1, but showing a modified construction.

Figure 17:
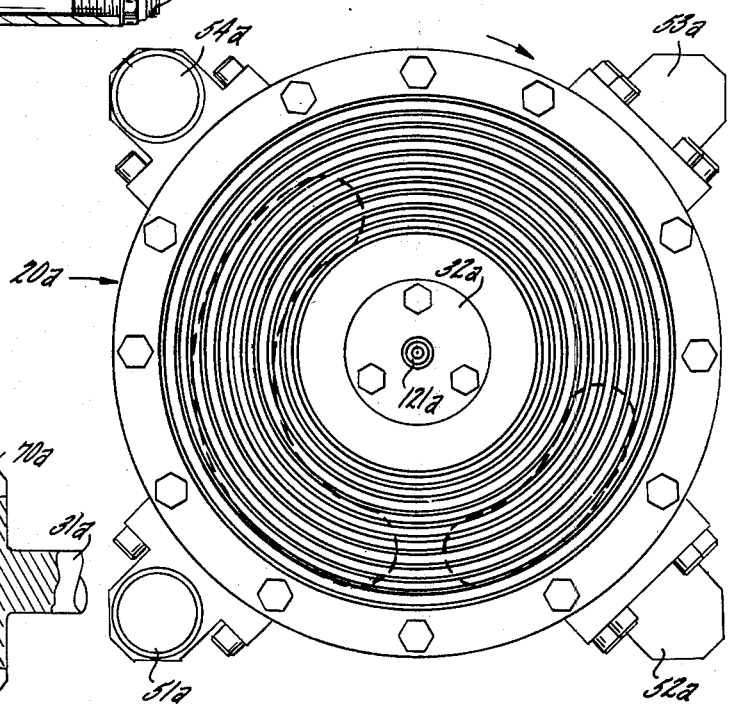

FIG. 17 is an end view of the unit shown in FIG. 16 looking along line 17—17 in the latter figure.

Figure 18:
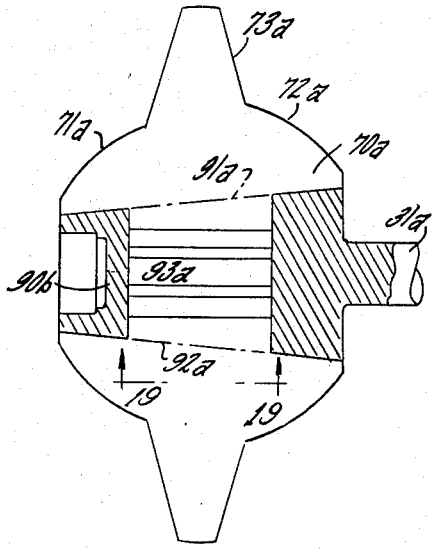

FIG. 18 is a view similar to FIG. 10*a* but showing a modified rotor construction.

Figure 19:
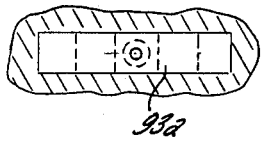

FIG. 19 is a fragmentary view looking along line 19—19 in FIG. 18.

Figure 20:
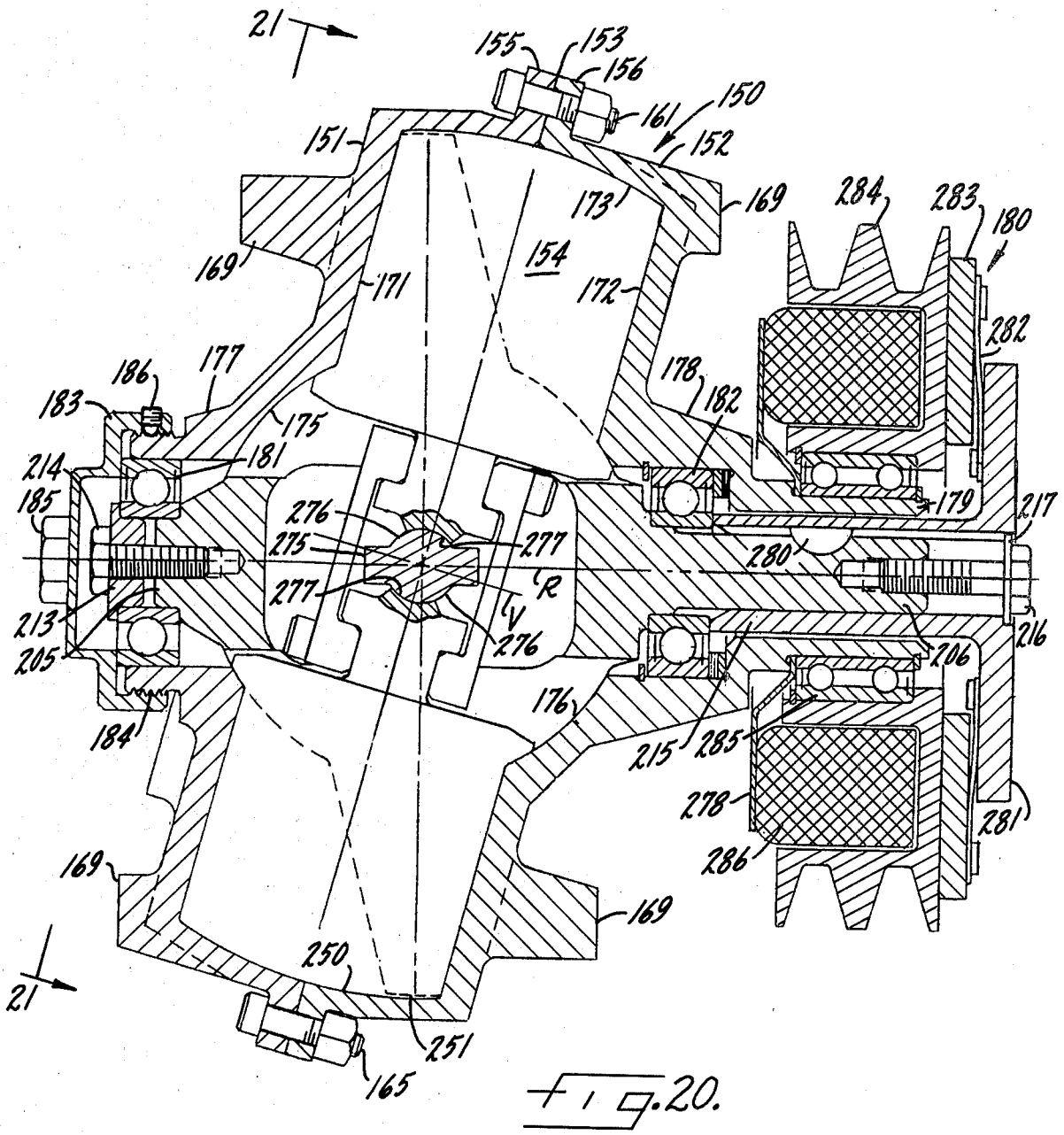
Figure 21:
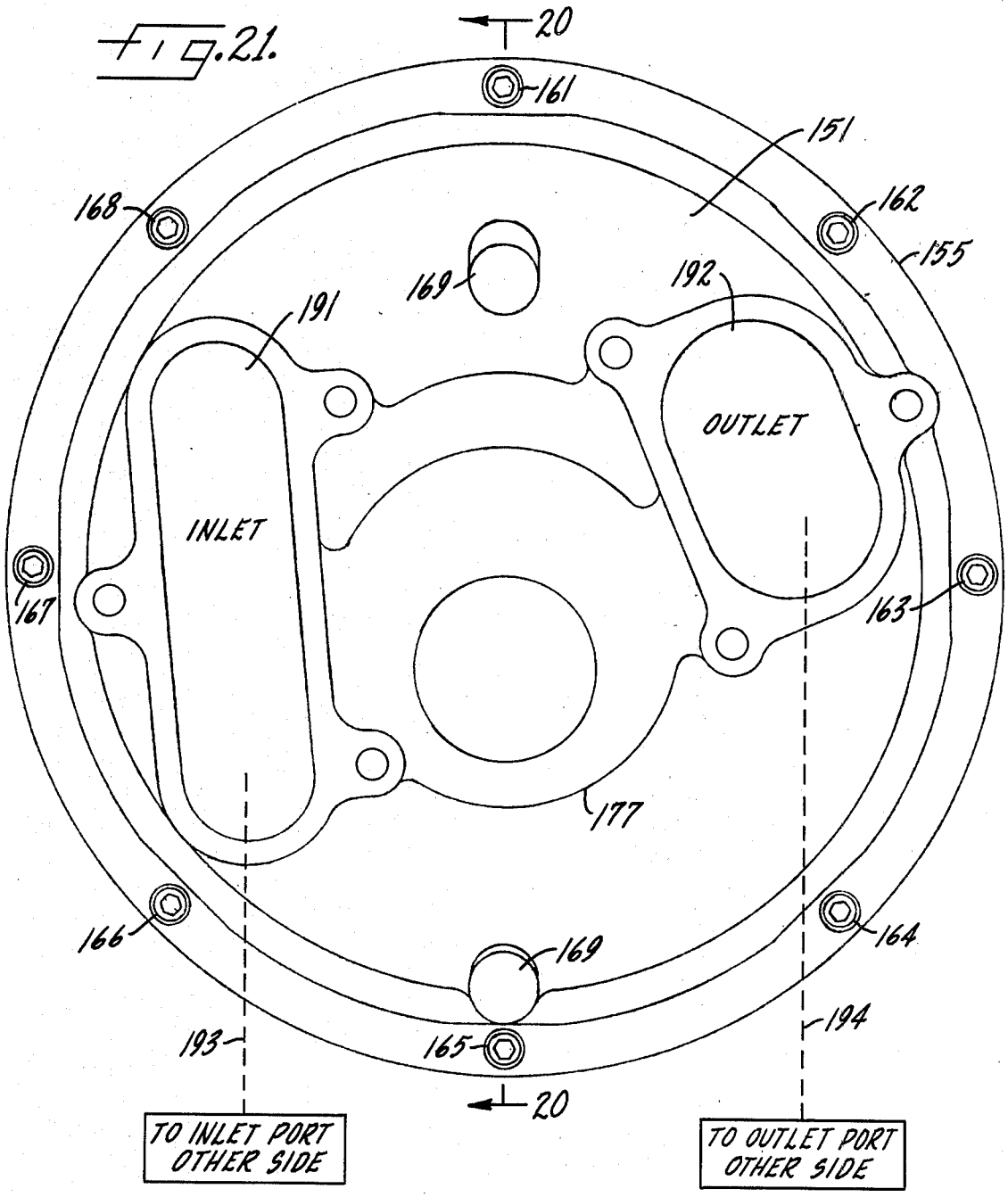

FIG. 20 is an axial cross section showing another form of the present invention as viewed along line 20—20 in FIG. 21.

FIG. 21 is an end view of the housing showing the porting end as viewed along line 21—21 in FIG. 20.

Figure 22:
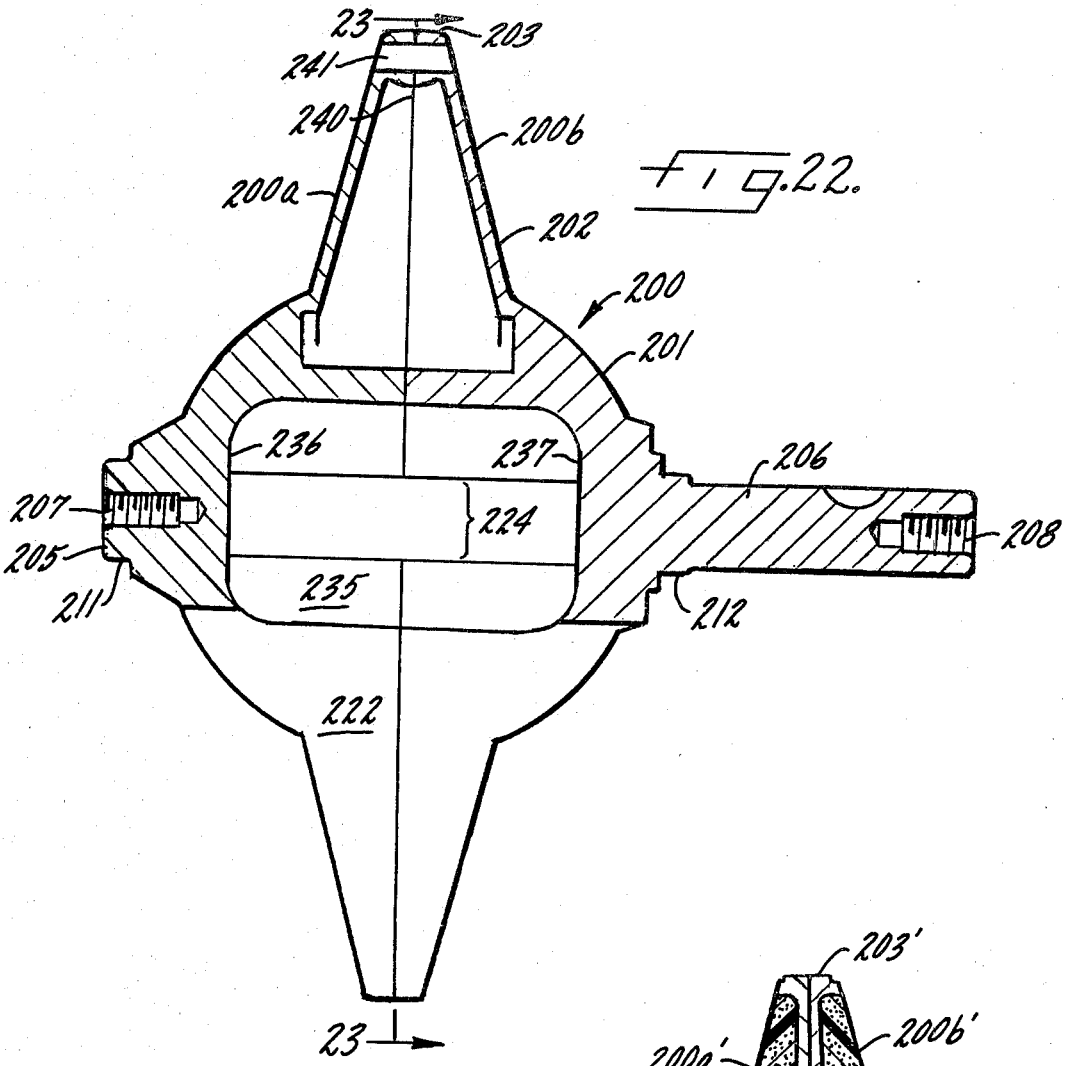
Figure 23:
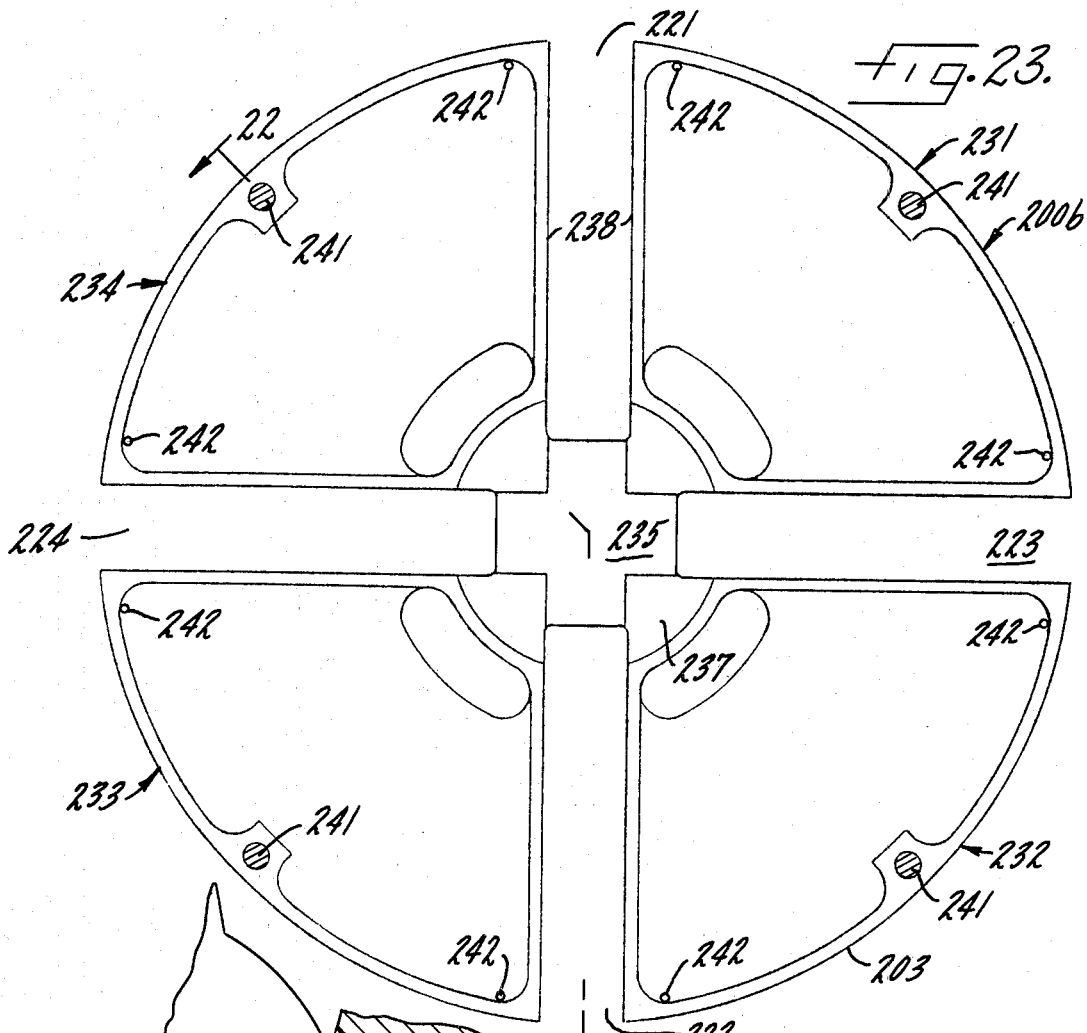

FIG. 22 is an axial section taken through the rotor taken along the line 22—22 of FIG. 23.

Figure 22A:
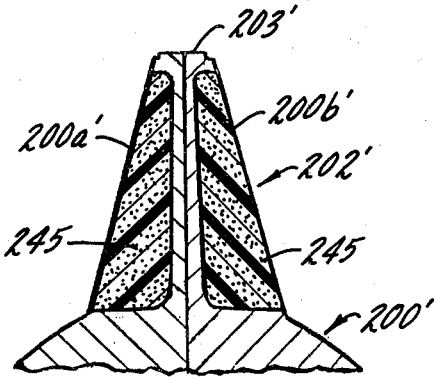

FIG. 22*a* is a fragmentary section similar to FIG. 22 but showing a modified rotor ring construction.

FIG. 23 is a transaxial section taken through the rotor and viewed along line 23—23 in FIG. 22.

Figure 24:
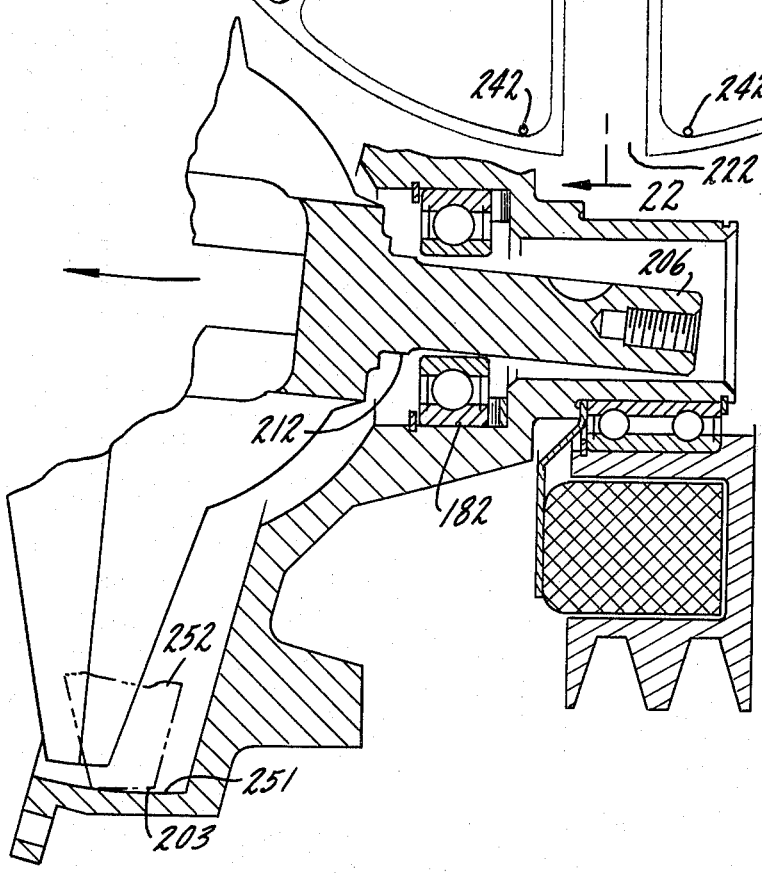

FIG. 24 is a fragmentary section showing the mode of assembly and disassembly of the rotor with respect to the housing.

Figure 25:
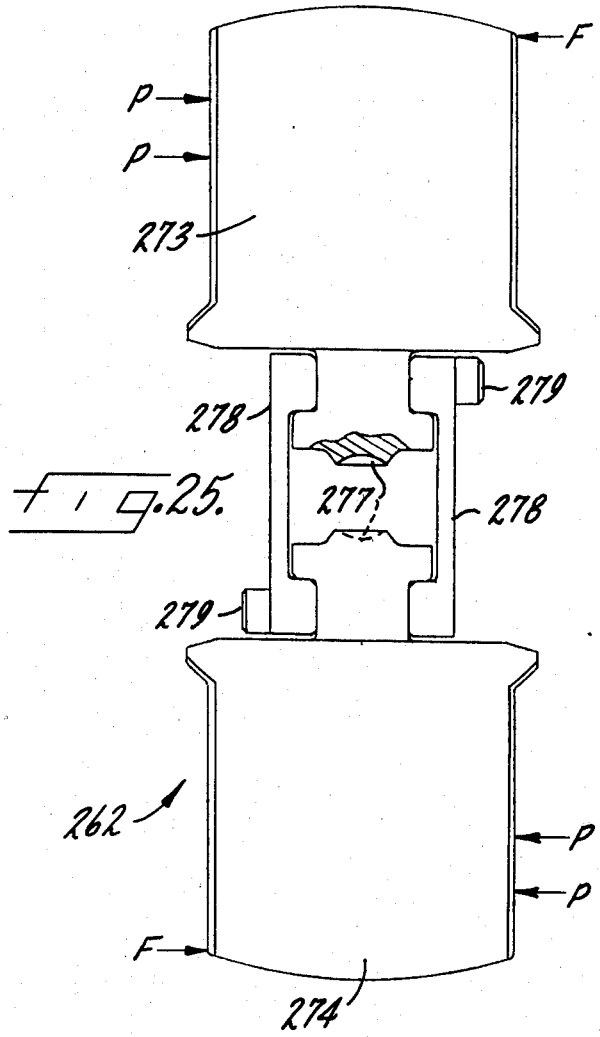

FIG. 25 is a face view of one of the vane pairs.

Figure 26:
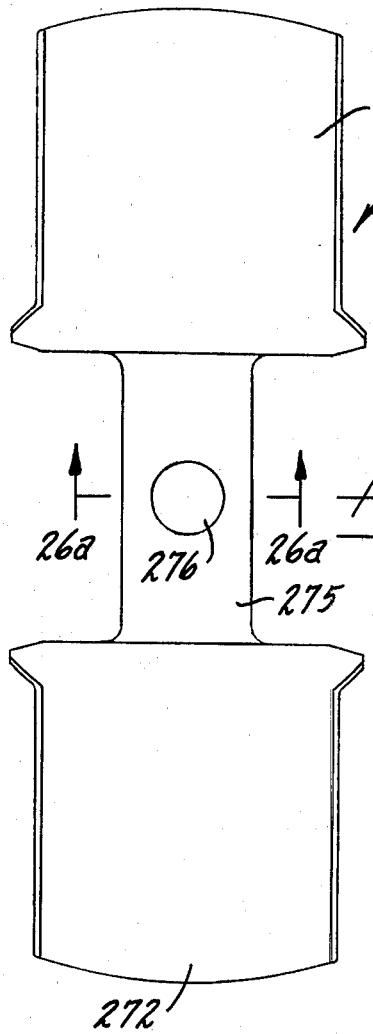

FIG. 26 is a face view of a companion vane pair.

Figure 26A:
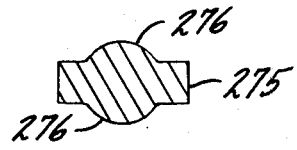

FIG. 26*a* is a transverse section taken along line 26*a*—26*a* of FIG. 26.

Figure 27:
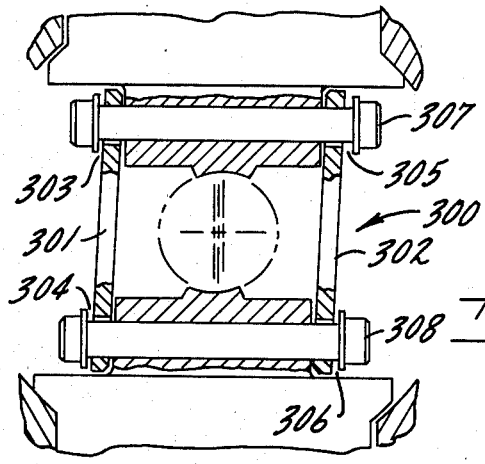

FIG. 27 shows a modified form of first vane pair providing for parallelogram type articulation.

Figure 28:
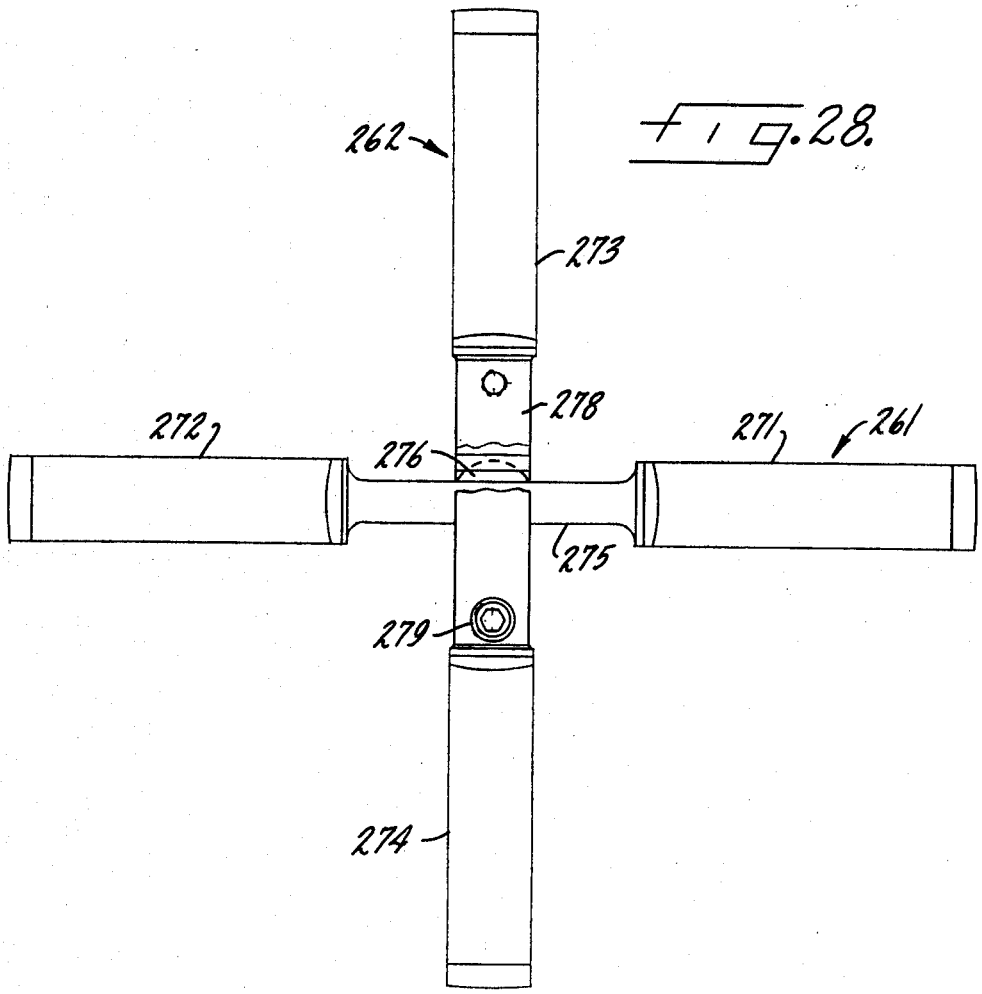

FIG. 28 shows the vane pairs of FIGS. 25, 26 in assembled relation.

Figure 29:
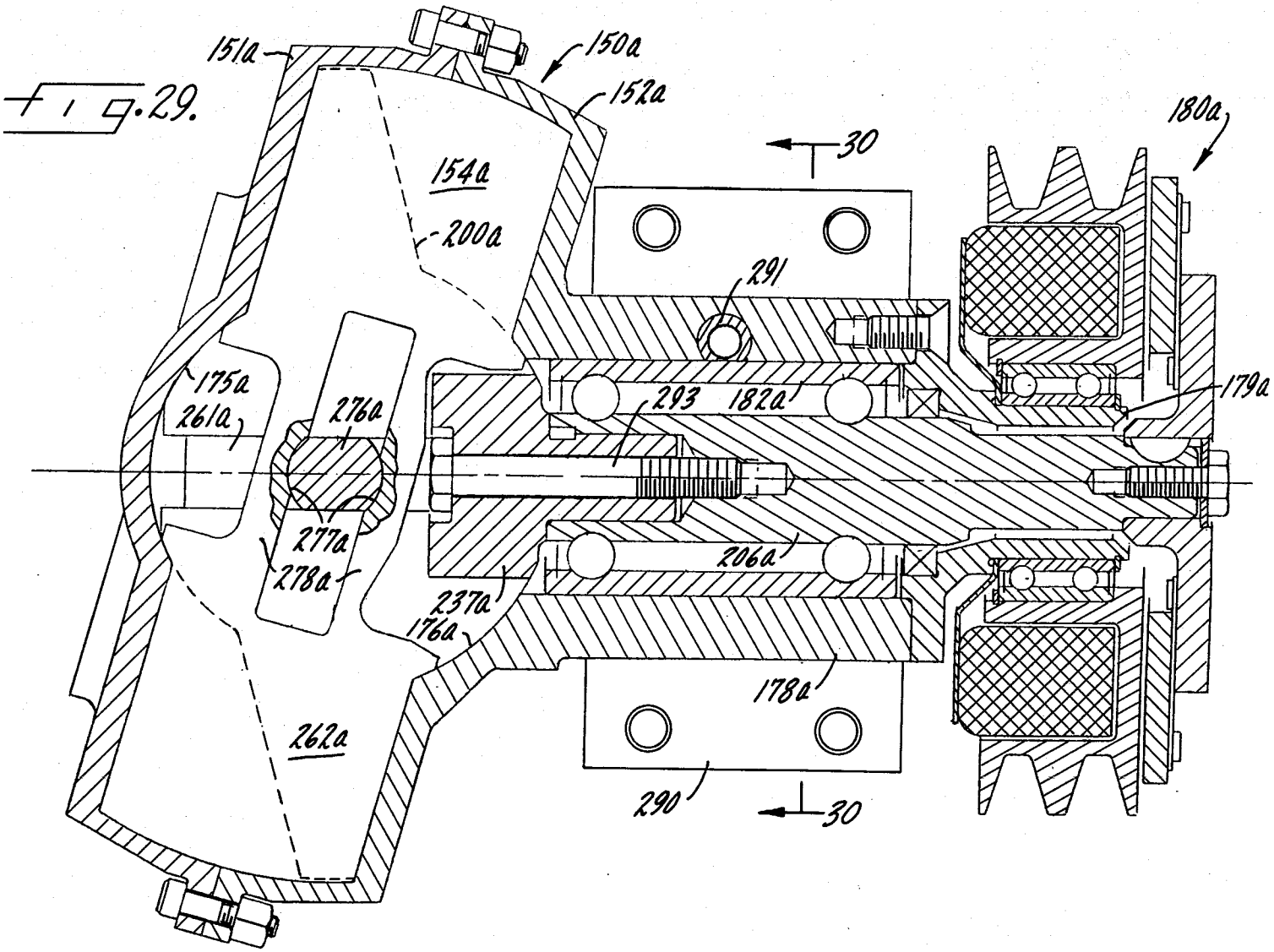

FIG. 29 shows, in axial section, a still further embodiment of the invention suitable for cantilever mounting.

Figure 30:
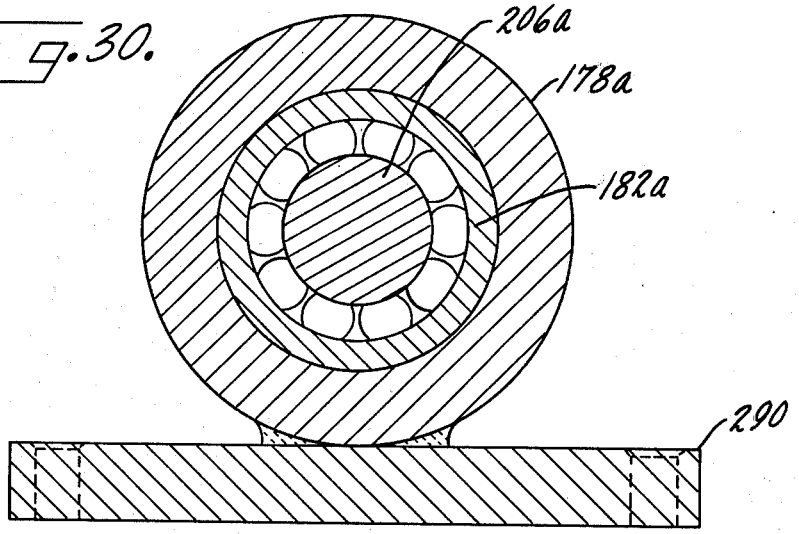

FIG. 30 is a transverse section taken through the shaft and mounting along line 30—30 in FIG. 29.

Figure 31:
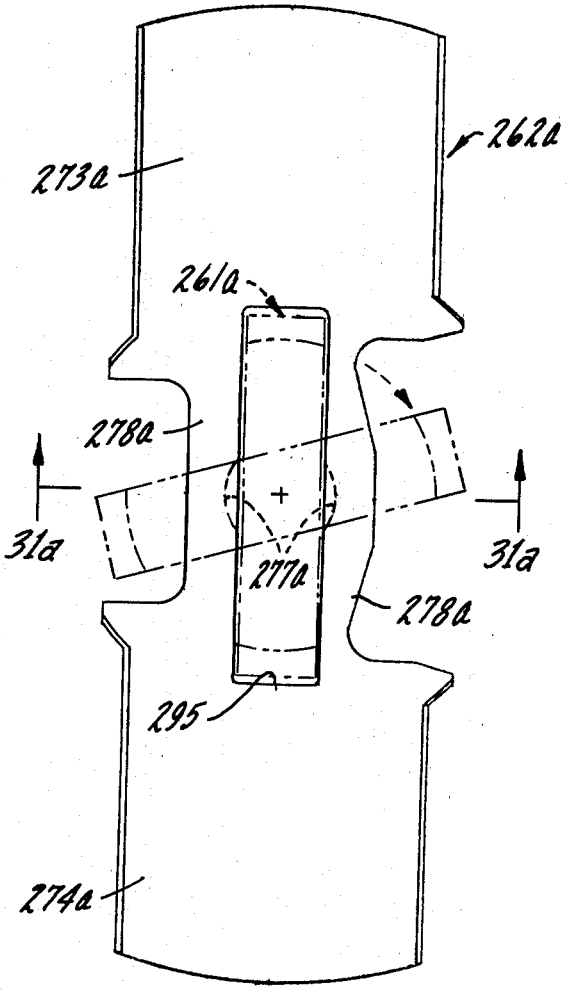

FIG. 31 is a face view of one of the vane pairs employed in the construction of FIG. 29.

Figure 31A:
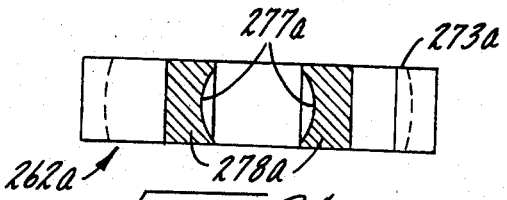

FIG. 31*a* is a section taken through the central portion of the vane pair of FIG. 31 along line 31*a*—31*a*.

Figure 32A:
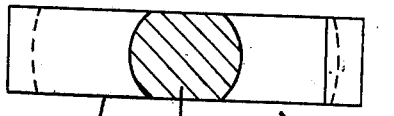
Figure 32:
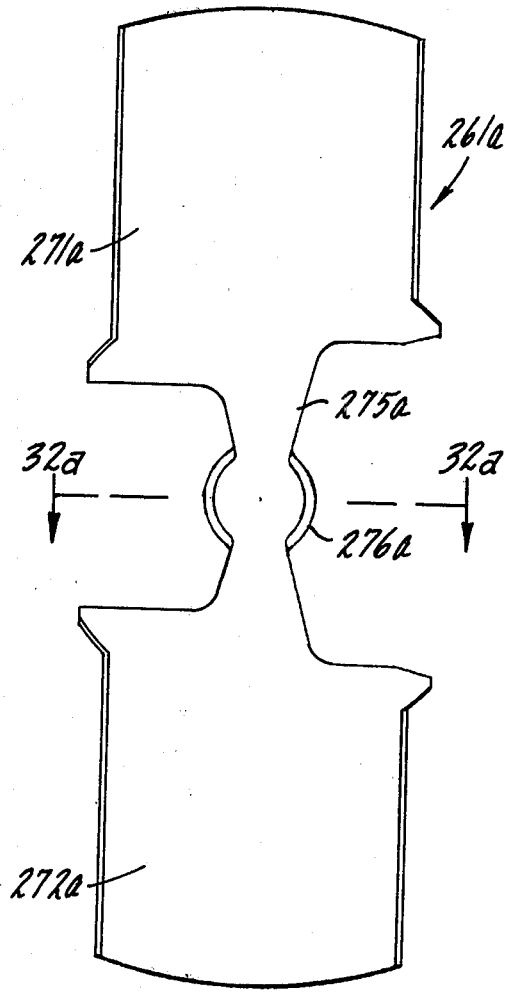

FIG. 32 shows the cooperating vane pair employed in the construction of FIG. 29.

FIG. 32*a* is a cross section taken along line 32*a*—32*a* in FIG. 32.

While the invention has been described in connection with certain preferred embodiments, it will be understood that we do not intend to limit the invention to the particular embodiments shown but intend, on the contrary, to cover the various alternative and equivalent constructions included within the spirit and scope of the appended claims.

Figures 1A, 1B, 2, 3:
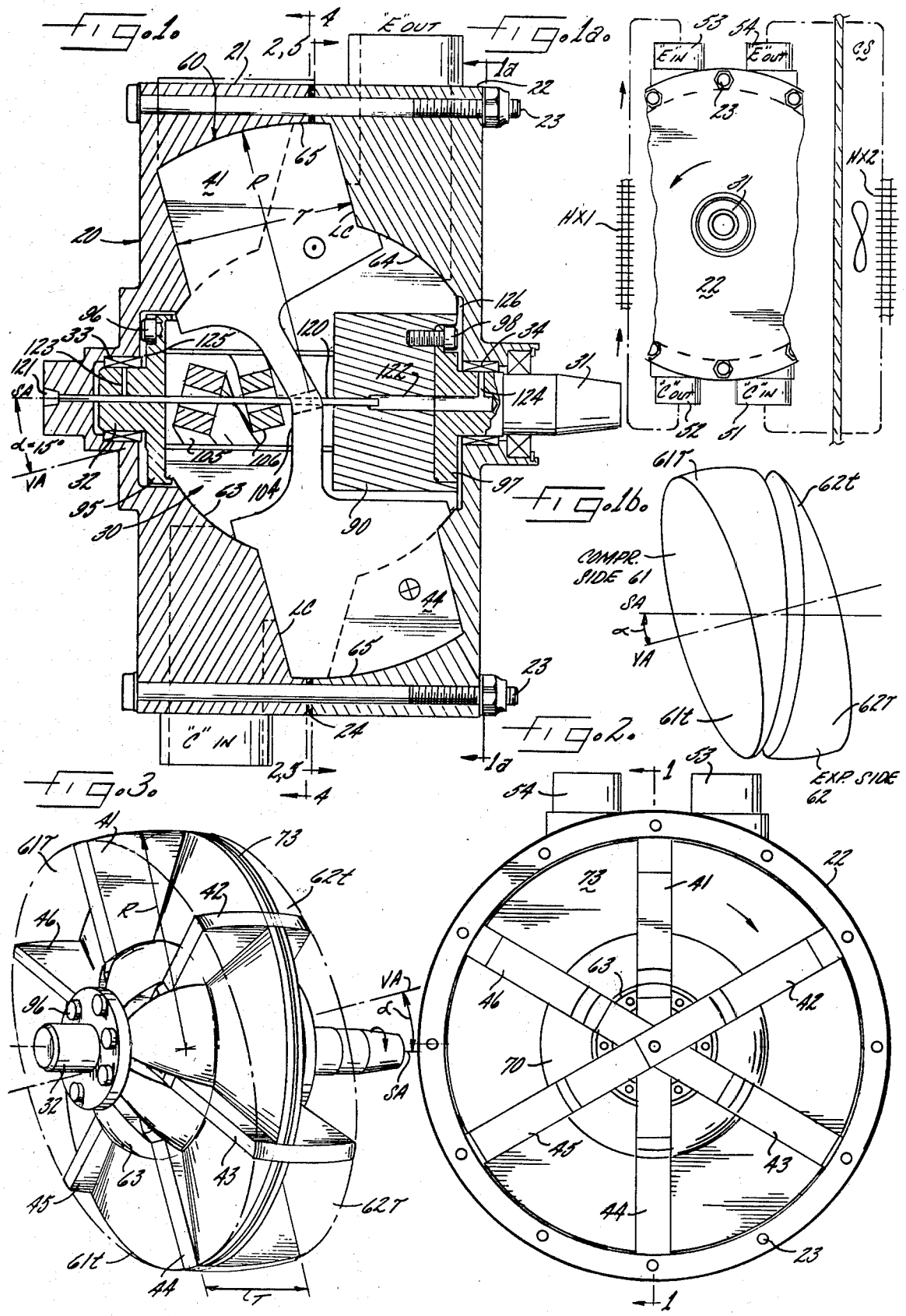
FIG. 2 is a view of the interior of the device of FIG. 1 looking along line 2—2 therein with the left-hand end bell removed.
FIG. 3 is a perspective view showing the rotor of FIGS. 1 and 2 with the vanes assembled therein.

Turning now to FIGS. 1-3 there is shown a compresso-expander unit having a frame 20 formed of two portions 21, 22 arranged face to face and secured together by a circle of bolts 23. Clamped between the two halves is preferably a thin layer of insulation 24 to which reference will later be made.

Mounted for rotation within the housing is a rotor 30 having a shaft formed of complementary stub shafts 31, 32 respectively supported in bearings 33, 34. Recessed in the rotor are a series of radially extending vanes 41-46. As brought out in FIGS. 2 and 3, the vanes are utilized to form compressor and expander compartments in which the air is positively compressed and then positively permitted to expand, with a heat exchanger interposed to remove the heat of compression, thereby to form a refrigeration system. Referring to the port connections shown in FIG. 1*a*, air is taken in at a compressor inlet port 51, compressed and heated and then conducted out of the compressor side through a compressor outlet port 52. The heat of compression is removed by a heat exchanger HX1 following which the air is fed into an expander inlet port 53. In the expander side the air is expanded, accompanied by a large drop in temperature, with the air exiting from the expander outlet port 54 either directly into a cooled space CS or into a secondary heat exchanger HX2 which cools the space with the help of a fan. Where a secondary heat exchanger HX2 is employed, the system is referred to as "closed" and sufficient air may be enclosed in the system so that the pressure in the secondary heat exchanger, and indeed in the entire system, is raised substantially above atmospheric to bring about an improvement in thermal efficiency.

In accordance with the present invention the housing has a disc-shaped main cavity with adjacent hub recesses, the main cavity being in the form of a doubly truncated sphere symmetric about a vane axis which is canted at an angle $\alpha$ with respect to the shaft axis. The axial recesses in the housing are defined by concave spherical surfaces concentrically opposed. A rotor is provided in the housing having a central portion which is spherical in shape for mating with the concave spherical surfaces, the rotor including an integral Saturn-like ring symmetric about the shaft axis and having outwardly convergent sides of shallow cone shape, the ring extending to the outer wall of the main cavity, thereby dividing the cavity into compressor and expander sides each of annular wedge shape having axially thick and thin portions arranged in complementary fashion.

Referring to FIG. 1*b*, which shows the truncated spherical shape of the main cavity 60, it will be noted that the cavity, or vane, axis, VA, is canted, by an angle with respect to the shaft axis SA, with the ring on the rotor 30 dividing the cavity into a first, or compressor, side 61 and a second or expander side 62. The compressor side 61 has an axially "thick" portion 61T and an axially "thin" portion 61*t*. The expander side 62 has a complementarily arranged thick portion 62T and a thin porton 62*t*. It will be understood that the vanes 41–46 (FIG. 2) rotate jointly in the sides 61, 62, defining the compartments therein which undergo positive increase and positive decrease in volume as the rotor rotates. For the purpose of mounting and sealing the rotor, the main cavity 60 is provided with opposed spherical recesses 63, 64. The outer spherical surface of the main cavity is indicated at 65.

More detailed attention will next be given to the construction of the rotor 30 which is mounted in the disc-shaped space 60 and which mates with the spherical recesses 63, 64, reference being made to FIGS. 7–10 inclusive. The rotor has a central spherical portion 70 having spherical surfaces 71, 72 on the compressor and expander sides, respectively, which mate with the concave spherical surfaces 63, 64 previously referred to. Extending outwardly from the spherical portion 70 is an integral Saturn-like ring 73 of trapezoidal cross section and of symmetrical, or isosceles, shape presenting a circular band 74 at the periphery lying in a spherical locus and which may be grooved for labyrinth sealing is symmetrically distributed about the shaft axis and has sides of shallow conical shape which are inclined, with respect to a transverse plane 75, by an angle which equals the canting angle (FIGS. 1,10*a* and 3) between the vane and shaft axes. In other words, the included angle of the trapezoid is double the angle $\alpha$. As a result, the sides of the ring engage, and conform to, the wall of the vane cavity at 180° positions along respective lines of contact defining regions of zero thickness of the sides 61, 62 of the main cavity 60.

For the purpose of accommodating the vanes 41—46, the rotor body 30 is formed with radially extending slots 81', 86' which are arranged in diametrical pairs aligned with the shaft axis SA, the diametrical slots defining rotor sectors 81–86. In carrying out the invention the rotor body is provided with a solid core which occupies an offset position at one end leaving the major portion of the body hollow at the center for the crossing of the rotor vanes to be described. The solid offset core, indicated at 90, and the adjacent typical slot 81', 84' may be formed by taking a total of three cuts, thereby forming a slot of C-shaped profile, two axial cuts 91, 92 (FIG. 10*a*) and a third, or transaxial, cut 93. This leaves a cantilevered end portion 94 for each of the sectors. The cantilevered ends are embraced by a cap 95, integral with the stub shaft 32, and which is held in place by screws 96. At the "core" end of the rotor body a cap 97, integral with the stub shaft 31, is held in place by screws 98.

In accordance with the present invention the vanes have a profile substantially corresponding to the profile of the truncated spherical main cavity, the vanes being provided in opposed pairs integrally connected together in a "dumbbell" shape having a relatively narrow neck which is axially offset, the paired vanes being preferably formed of a single plate of metal and with the necks between cooperating vanes being offset by different amounts to permit crossing of one another at the center of the rotor body. Referring to FIGS. 1 and 13, the three vane plates, each formed integrally from flat plate of metal and indicated at 101, 102 and 103, are of reduced section at the center to form necks 104, 105 and 106 which, as shown in FIG. 1, are all accommodated side by side at the center of the rotor body, being axially offset.

In accordance with one of the aspects of the invention each vane has a spherically shaped tip surface having a a radius R equal to that of the truncated sphere together with lateral edges lying in the locus of a cylinder with a radius equal to T/2, where T is the thickness of the truncated sphere. Each vane also has a thickness of at least $t=T \sin \alpha$, where $\alpha$ is the degree of cant of the truncated sphere axis relative to the shaft axis. This relationship can be verified in FIG. 14 which shows the cross section of a typical vane having a width dimension of T where T is the thickness of the main cavity. By making the vane thickness t at least equal to $T \sin \alpha$, there will be assurance that constant clearance will exist along the wall of the main cavity in spite of the relative twisting of the vane in the cavity which occurs during the course of rotation about the two axes.

In accordance with one of the aspects of the invention each of the vane tips is vented to the center of the rotor by a vent opening 107 which communicates with a recess 108 bounded by a land 109. This insures balanced end-pressures on the vanes.

It is a further feature of the present invention that each of the vanes is laterally extended to form shoulders 111, 112 which are spherically surfaced at mating with the concave spherical surfaces 63, 64 in the cavity. The "area" engagement provided by the shoulders against the spherical recesses serves to prevent leakage between the compartment on the respective sides of the vane and the central cavity of the device.

Having understood the construction of the housing, rotor and vanes, it is one of the features of the present invention that the ports include arcuate grooves on the side walls of the main spherical cavity 60, the grooves being opposite the ring portion of the rotor. The shape of the grooves, and their phasing, for the compressor and expander sides of the machine can be understood by reference to FIGS. 4 and 5 respectively.

Figure 4:
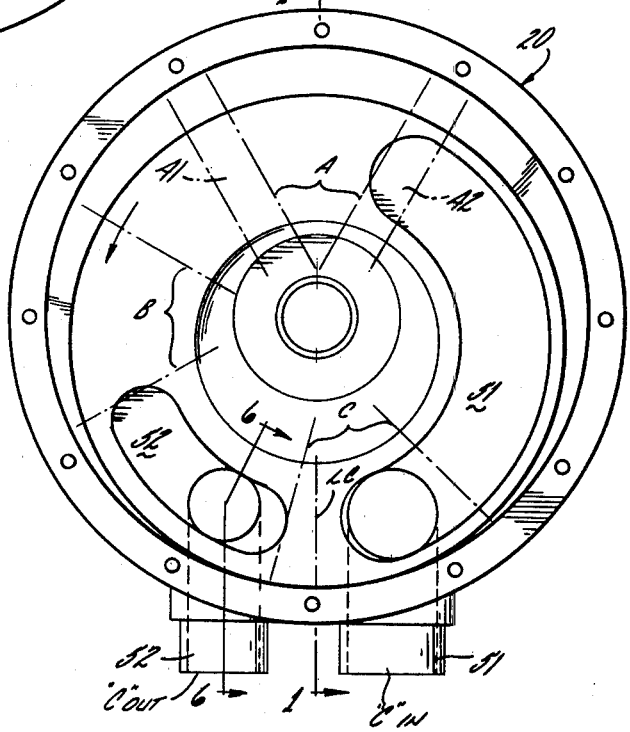
FIG. 4 shows the interior of the left-hand end bell looking along line 4—4 in FIG. 1 with the rotor removed to reveal the porting on the compressor side.
Figure 7:
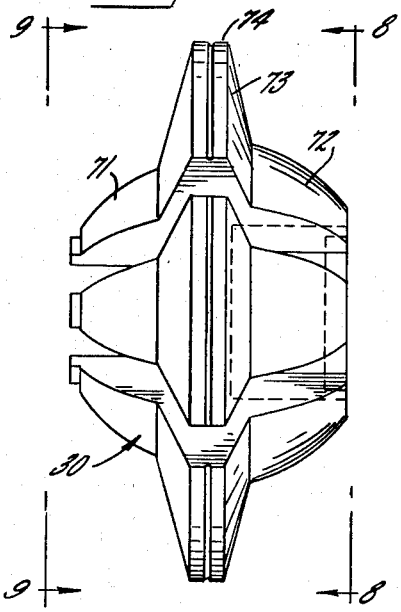
FIG. 7 is an elevational view of the rotor body.
Figure 9:
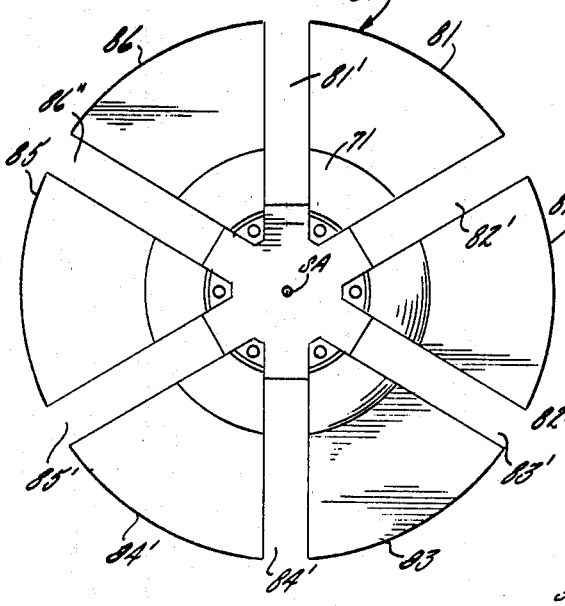
FIG. 9 shows the blind end of the rotor body looking along line 9—9 in FIG. 7.

Taking first the compressor side, FIG. 4, it will be noted that the inlet port 51 is arcuately extensive lying in advance of the thickest portion of the wedge-shaped 61 (see FIG. 1*b*) while the output port 52 is relatively concentrated and located just prior to the thinnest portion of the wedge. In operation, as a chamber defined between vanes 41, 42, for example, swings past the long arcuate port 51 toward the thick dimension of the compressor side, it sucks in air through the port until it reaches position A where the chamber has its maximum volume and at which point communication with the port 51 is about to be cut off. After leaving position A, the chamber progressively moves toward the thin portion of the compressor side, compressing the captive air until position B is reached at which time communication is established with the compressor outlet port 52. By the time position C is reached the chamber has squeezed all of its air into the compressor outlet port 52 and, having swung beyond the line of "ring" contact LC, is beginning to expand and fill itself through the compressor inlet port 51 to begin another cycle.

Figure 5:
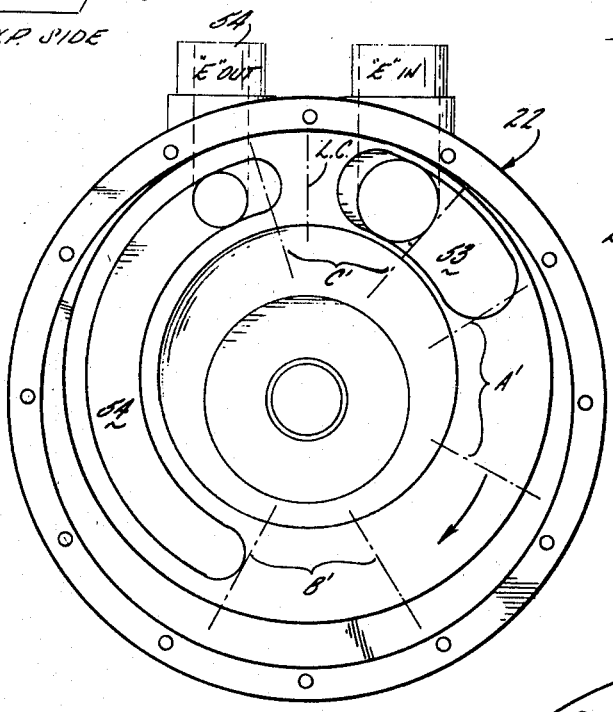
FIG. 5 is a view similar to FIG. 4 but looking in the opposite direction to show the porting on the expander side.

Conversely, the expander side has a relatively concentrated inlet port 53 just following the thinnest portion of the wedge-shaped space 62 (FIG. 1*b*) and has an arcuately extensive outlet port 54 following the thickest portion of the wedge, so that air entering the expander inlet is expanded and cooled for discharge. Referring to FIG. 5, a typical chamber is illustrated at position A' in the act of being filled through the expander inlet port 53, the chamber being just prior to the point of cut-off. The chamber, upon rotation of the shaft, proceeds from position A', expanding in volume as it approaches the region of axial thickness, until it reaches position B'. During the movement from A' to B' the air is both expanded and cooled and, at point B', it begins to be discharged through the expander outlet port 54.

The expanded air continues to be discharged from the outlet port 54 until the chamber reaches position C' at which further escape is cut off and at which the chamber begins to be filled with pressurized air through the expander inlet port 53, thereby completing a cycle. It is to be noted that the lines of contact LC between the ring portion of the rotor and the wall of the main cavity prevent any direct flow between the related inlet and outlet ports both on the compression and expansion sides.

To summarize, with respect to the circuit diagram shown in FIG. 1*a*, a parcel of air enters a chamber through inlet port 51, being completely filled at position A (FIG. 4), and is rotated through positions B and C during which the chamber is reduced in size so that compressed and heated air flows from the outlet port 52. The heat of compression is removed in heat exchanger HX1. The cool but pressurized air flows into the expander inlet port 53 filling a chamber at position A', with progressive rotation into position B' during which the air expands and cools, with the cooled air being discharged into the expander outlet port 54, discharge being completed by the time that the chamber reaches position C'. The air from the expander outlet port 54 may flow directly into the cooled space CS or may flow through a second heat exchanger HX2, in a closed loop, back to the compressor inlet port 51.

Figure 6:
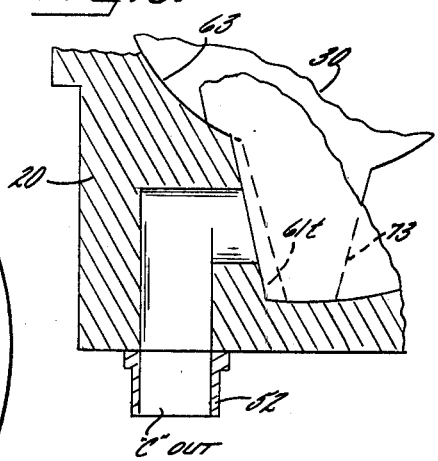
FIG. 6 is a fragmentary section taken along line 6—6 in FIG. 4 showing the compressor outlet port.

It is one of the features of the present construction that the ports extend into the regions 61*t*, 62*t* where the wedge-shaped compressor and expander sides are "thin". Since the housing is of cylindrical shape the housing wall at the such regions is relatively thick as shown in FIG. 6, thereby permitting an elbowed right-angled bend in the air flow, with the port being brought out to a radially extending connection while preserving large port cross sections to insure efficient air transfer with a limited degree of throttling or "wire drawing".

It is one of the features of the present invention that the average chamber size is less on the expansion side than on the compression side so that a smaller volume of air will be handled per revolution on the expansion side thereby to compensate for the difference in temperature between the air on the compression and expansion sides and to insure that equal masses of air are handled on a per revolution basis. Thus, referring to FIG. 10*a*, the radius r2 of the spherical surface 72 on the rotor (which engages recess 64 in the cavity) on the expansion side is substantially greater than the radius r1 of the spherical surface 71 (which engages the spherical recess 63) on the compression side. The greater radius results in smaller chambers on the expansion side. Calculating a specific ratio of r2 to r1 required for the transport of equal masses of air per revolution is a matter well within the skill of the art, given the temperature of the air on the two sides which in turn depends upon the heat rate of the heat exchanger HX1 under a given set of conditions.

In accordance with a further feature of the present invention, means are provided for supplying lubrication to both the bearings 33, 34 and the corresponding spherical surfaces 63, 64. As shown in FIG. 1 this is accomplished by providing an axially extending lubricant tube 120 having an inlet fitting 121, the tube extending through clearance openings in the necks of the vane plates and communicating with an axial bore 122 in the core 90 and cap 97. Extending from the tube and bore, respectively, are radial passageways 123, 124 leading to the bearings 33, 34. Further annular passageways 125, 126 adjacent the respective rotor end caps conduct lubricant, assisted by centrifugal action, from the bearings to the spherical surfaces 63, 64 where the lubricant provides lubrication for both the spherical surfaces on the rotor and the spherical shoulder surfaces 111, 112 on each of the lateral edges of the vanes.

It is a still further feature of the present invention that thermal insulation is provided to prevent short circuiting of heat within the machine, that is, to thermally isolate, to large degree, the compressor and expander sides of the machine. The thermal insulation in the housing, indicated at 24 in FIG. 1, lies in a plane which is generally symmetrically positioned with respect to the rotor and perpendicular to the rotor axis. Similarly it is desirable for a layer of thermal insulation to be provided in the rotor as indicated in FIG. 12, the insulation lying in a symmetrical position in a plane perpendicular to the rotor axis as indicated at 130, the layers 24, 130 being preferably in alignment with one another. To maintain the two halves of the rotor securely fastened together to form a monolithic structure, axially extending clamping screws 131 are provided as shown in FIG. 12, with the rotor halves being kept in accurate alignment by locator pins 132. Isolation of the two sides may be still further improved by providing a layer of insulation 13*a* on the medial line of each vane as indicated at 130*a* in FIG. 15 or by making the vanes, and if desired the rotor and stator, of low conductivity material such as ceramic or plastic.

While it is preferred to machine the necessary vane slots in the rotor body, it will be understood by one skilled in the art that the rotor sectors 81–86 may be separately and economically constructed, for example, using powder metallurgy, and individually secured to the rotor core 90 by means of suitable machine screws 135 as indicated in FIG. 11. Where such construction is used, the cap 95 (FIG. 10*a*) provides adequate reinforcement at the cantilevered ends.

It is contemplated, however, that the rotor may be machined to provide two solid cores at the respective axial ends with a through-opening between them and with the diametrically related vanes being made of multi-piece construction with a narrow neck extending through the through-opening.

Thus referring to FIG. 16–19 a modified construction is shown which is distinguished by use of two axially spaced solid cores in the rotor indicated at 90*a*, 90*b* with a multi-piece vane construction indicated at 43*a*, 46*a*, the remaining elements being identified with corresponding reference numerals plus subscript a. The slots in the rotor body are preferably formed by making a pair of cuts 91*a*, 92*a* (FIG. 18) much as in the earlier construction, followed by a plunging cut to produce through-opening 93*a* (see FIG. 19). This is done for each pair of slots so that the center of the rotor body is hollow for passage of the necks 104*a*, 105*a*, 106*a* of the respective vane pairs.

A typical vane pair is shown in profile, and in partial section, in FIG. 16. Here it will be noted that the individual vanes 43*a*, 46*a* are interconnected by a hollow tubular neck member 106*a* having ends secured in radial openings provided in the vanes. The securing is a matter well within the skill of the art; for example, the neck member 106*a* may have threads of opposite hand at its ends engaging tapped holes in the vanes, thereby serving not only to structurally integrate the vanes but also to provide a means for precise adjustment of vane length.

By using a pair of solid cores 90*a*, 90*b*, one at each end of the rotor, the rotor integrity is improved. And, if desired, the left-hand stub shaft 32*a* may be secured to the housing and centrally received in an anti-friction bearing mounted in the core element 90*b*. The term "having stub shafts", as applied to the rotor, therefore includes any stub shaft employed for rotor support. Also, if desired, the driving stub shaft 31*a* may be integral with the core 90*a*. Since the vane necks do not, in the structure of FIG. 16, permit axial placement of the lubricant tube, the lubricant tube, indicated at 120*a*, is preferably offset a short distance from the axis as shown. The term "axially extending" as applied to the lubrication tube thus includes a tube which is offset from the axis of rotation. Otherwise lubrication substantially corresponds with that in the previous embodiment. The port connections, indicated at 51*a*–54*a*, are, as shown, somewhat more widely spaced than in the early embodiment, but the radial ports therefor still extend through the "thick" portion of the wall at 180° positions so that the benefit of using a sizeable air passage is retained.

While the term "air" has been used above to denote the refrigerating medium, and while the use of air is preferred, it will be understood that the term is used in a generic sense to include equivalent gases.

Also while the invention has primary application to a device which both compresses and expands air in its respective sides, employing the converse porting illustrated respectively in FIGS. 4 and 5, it will be understood by one skilled in the art that porting of the type illustrated in FIG. 4 may be employed on both sides of the machine, thereby converting it into a two-stage compressor, with the ports being serially interconnected to provide the two increments of pressure. Alternatively, the input and output ports on each side may be respectively connected together to produce a low pressure compressor having a large volumetric capacity. Or, if desired, porting of the type illustrated in FIG. 5 may be used on both sides of the machine thereby turning it into a two-stage expander, or motor, with the ports being connected either in series or parallel. Where the device is employed as a series two-stage motor or compressor, compensation is still highly desirable, with the radii r1,r2 of the central spherical portion of the rotor being in such ratio, depending upon the temperature differential, as will cause equal masses of air or equivalent fluid to be passed on each side of the machine during each revolution.

While the operation has been discussed in connection with air as a single medium, it will be understood that the operation is not limited thereto and that use of an additive of a type undergoing change of state within the pressure and temperature encountered in the unit. An additive such as water, may be employed, particularly when the system is "closed" as shown in FIG. 1*a*, to improve the heat rate and coefficient of performance, cross reference, in this connection, being made to prior U.S. Pat. No. 3,913,351 which issued on Oct. 21, 1975 and 3,967,466 which issued on July 6, 1976.

It will be apparent that the objectives of the invention have been amply carried out. Instead of the rapid back and forth movement of the vanes which characterizes the prior construction, the vanes in the present device undergo smooth and free rotational movement about the vane axis, thereby making possible higher rotative speeds and greatly reducing noise and vibration, as well as bringing about a reduction in friction. The latter, combined with a reduction in the short circuiting flow of heat between the two sides of the machine improves efficiency as measured in terms of coefficient of performance. The high speed of rotation plus improvement in efficiency make the device capable of operating at exceedingly high heat rates, making the device particularly suitable for use in the heat transfer mode in a winter-summer air conditioning system.

A version of the device which may be used either as a compressor, expander, or both, but which is particularly suited for use as an automotive supercharger operated in the parallel compressor mode is illustrated in FIG. 20. Here a housing 150 is provided formed of two complimentary sections 151, 152 having a parting plane 153 which symmetrically bisects a main cavity 154 along a plane perpendicular to the axis V thereof, also referred to as the vane axis. Such axis is canted at an angle of 15 degrees with respect to a rotor axis R.

The two sections 151, 152 of the housing are complementary and of corresponding shape and size. The sections have annular flanges 155, 156 respectively, extending radially outwardly along the parting plane. The flanges have axially extending bolt holes formed therein, the bolt holes being of equal radii and spaced at equal angles in diametrically related pairs so that the holes are in register when the sections are 180 degrees out of phase. Bolts 161–168 clamp the two sections together, the holes which are engaged by bolts 161, 164 and 166, being closely fitted to insure accuracy of mating. Integrally formed on the sections are pedestals 169 which may be drilled and tapped for mounting purposes.

The main cavity 154, which is in the shape of a doubly truncated sphere, has parallel side walls 171, 172 and a spherical peripheral wall 173. The cavity has, formed in its side walls, concave axial recesses 175, 176 which lie in a spherical locus concentrically opposed to one another. The two sections of the housing have outwardly projecting bosses 177, 178, the boss 178 having an integral, outwardly extending sleeve 179 carrying a drive control assembly 180, to which reference will be subsequently made. The bosses 177, 178 carry anti-friction bearings 181, 182 alined on the rotor axis R. For adjusting the axial position of the bearing 181, thereby to take up axial play, the bearing has a cap 183 threaded to the adjacent embossment at 184, the cap being rotatable by engagement of a hex head 185. After the take-up adjustment has been performed, the cap is held in adjusted position by means of a nylon tipped setscrew 186.

In use of the mechanism as a compressor, the housing section 151 is provided with an inlet port 191 and an outlet port 192 which, by respective conduits indicated diagrammatically at 193, 194 are connected in parallel with inlet and outlet ports on the companion section 152, the ports on the two sections being physically offset in phase by 180 degrees.

Journaled in the bearings is a rotor 200 (FIGS. 22 and 23) having a central spherical portion 201 and a Saturn-like ring 202 of isosceles trapezoidal shape having a relatively narrow peripheral surface 203 which extends to a position adjacent the peripheral wall 173 of the main cavity. At its ends the rotor has stub shafts 205, 206 having axially tapped openings 207, 208, respectively. The rotor is supported in the bearings upon shoulders 211, 212 which are narrow in axial dimension, with adjacent drop-off, for reasons to be explained.

For holding the first anti-friction bearing 181 axially captive with respect to the rotor, there is provided, adjacent the stub shaft 205 at the left-hand end, an annular retainer element 213 (FIG. 20) which is clamped in position by a clamping bolt 214. Similarly there is provided at the right-hand end a clamping element in the form of sleeve 215 which supports the right-hand side of the bearing 182, the sleeve being clamped in its position by a clamping screw 216 which bears upon a washer 217.

As illustrated in FIG. 23, the rotor is formed with diametrically extending vane slots 221, 222 and 223, 224 which are alined with the shaft axis to divide the rotor into four sectors 231–234, the slots intersecting to form a central hollow 235. For bridging the central hollow at the ends of the rotor, the sectors are interconnected by integral "cores" 236, 236 (FIG. 22). The sectors are enclosed by flat end walls 238 which engage and guide the vanes to be described.

In accordance with one of the aspects of the present invention, the rotor 200 is preferably formed of two cupshaped pieces 200*a*, 200*b*, with their hollows facing one another along a central parting line 240. The pieces 200*a*, 200*b* permanently joined by a set of pins 241. Alternatively, the two portions of the rotor may be brazed together along the parting line 240. The hollow spaces within the sectors are preferably provided with vent openings 242 which are located at the largest possible radius to insure ejection by centrifugal force of any lubricant or other liquid which may tend to collect.

If desired, the Saturn-like ring 202 may take the form set forth in FIG. 22*a* in which corresponding numerals are employed to represent corresponding elements with the addition of a prime. In this version the two opposed sections indicated at 200*a*′ and 200*b*′ are provided with outwardly facing hollows 245 which are filled with rigidified plastic foam. This effectively covers the rotor rings with a layer of thermal insulation which assists in defeating transfer of heat from one side of the device to the other, particularly where the device is used in the compressor-expander mode which may result in a substantial difference in temperature between the two sides.

In view of the angle of cant, here 15 degrees, between the shaft axis and the vane axis, positioning the parting plane 152 of the housing so that it symmetrically bisects the main cavity results in a condition of "reverse draft" which tends to hold the rotor captive in the housing sections. Thus it can be seen in FIG. 20 that any attempt to draw the rotor 200 out of the bearing 182 with purely axial movement would result in obstruction between the periphery of the rotor and the curved inner wall of the cavity in the region 250. Such problem is overcome by the use of the narrow shoulders 211, 212 on the shaft which engage respective bearings with adjacent drop-off, advantage being taken of the radial clearance which exists at 251 (FIG. 20) at the periphery of the rotor ring. This is made clear by reference to FIG. 24 which shows the sequence used in disengaging the rotor from the bearing 182.

As an initial step the clamping sleeve 215 is removed from the rotor shaft by unscrewing clamping bolt 216, thereby providing radial clearance around the shaft 206. Straight axial force is then applied to the rotor to move it to position 252, i.e., a sufficient distance so that the shoulder 212 on the shaft clears the left-hand edge of the bearing 182. The shoulder is made sufficiently narrow so that it is free of the bearing before the running clearance at 251 has been fully utilized. With the shoulder free of the bearing, the rotor may be tipped into the position illustrated in FIG. 24 and the rotor shaft freely withdrawn from the bearing at a slightly cocked angle.

The procedure may simply be reversed in assembly: the shaft is extended into the bearing at an angle until the shoulder on the shaft is encountered following which the rotor is rocked into a condition of alignment with the bearing and moved axially into its seated position on the shoulder. The same comments apply to engagement and disengagement of the rotor from the left-hand section 151 of the housing. Use of the narrow shaft shoulders in the above procedure makes it unnecessary to resort to special tapered bearings, although bearings of the tapered type may, if desired, be employed to overcome the problem without departing from the invention.

Vane pairs are provided as in the previously described embodiments, but somewhat differently constructed. Two cooperating vane pairs are disclosed in FIGS. 25 and 26 at 261 and 262. The vane pairs define vanes 271–274 which fit in correspondingly numbered slots 221–224 in the rotor. All of the vanes, similarly to the preceding embodiments, correspond to the profile of the main cavity having sides lying in a cylindrical locus and tip surfaces which lie in a spherical locus together with shoulders which also lie in a spherical locus, the shoulders engaging the respective spherical recesses 175, 176 (FIG. 1) for the purpose of preventing leakage.

The first vane pair 261 is integrally formed of plate of metal or equivalent which is centrally necked down to provide a connector 275. The connector 275 mounts a pair of "ball" embossments 276 which are centered on the vane pair and which are concentric with one another. The second vane pair 262 is of multi-piece construction, with the vanes 273, 274 being formed with central spherical recesses 277 which are also concentric with one another and which are tailored to mate with the embossments. The vanes comprising a vane pair 262 are interconnected by straps 278 which are axially spaced from one another and which are held in place by clamping screws 279.

The central ball and socket connection between the vane pairs causes each vane pair to be centered longitudinally with respect to the vane axis 155. This enables a predetermined running clearance to be established at each end of the vane pairs, greatly reducing friction and insuring smooth dynamically balanced operation as described in some detail in our co-pending application Ser. 116,155 filed Jan. 28, 1980.

The two vane pairs are assembled together at 90 degrees to one another for occupation of the respective diametrical slots in the rotor, as shown in FIG. 28. Assembly is a simple matter: The vanes are positioned in their 90 degree positions, the straps 278 are put into place and the screws 279 are turned tight. Following this the vane pairs are inserted between the two halves of the rotor and the rotor halves are secured tightly to one another to produce a rotor assembly which may then be slipped into the housing following the techniques described in connection with FIG. 24.

The operation of the construction as thus far described will become apparent in light of the description of the preceding embodiment: With the inlet and outlet ports connected in parallel (FIG. 21) air is simultaneously drawn in at the inlet ports on both sides of the device, compressed between the adjacent vanes and the wall of the main cavity on a controlled volumetric basis, and discharged at a substantially higher pressure at the outlet ports for supplying air under pressure to an automotive engine or the like. The ratio of pressure between inlet and outlet is determined by the phase positions of the inlet and outlet ports, a matter well within the skill of the art.

The present invention is not limited to any particular manner of driving the input shaft 206. The construction does lend itself well, however, to use of an integral clutch of the electromagnetic type as shown in cross section in FIG. 20. Here the sleeve 215 which surrounds the shaft 206, and which is coupled to it by means of a key 280, has an annular flange 281. The flange is connected by means of a flexible spider 282 to an annular magnetic armature 283 which serves as a movable clutch plate. A belt driven sheave 284 serves as the companion clutch plate. Such sheave is mounted on a bearing 285, the inner race of which is telescoped over the sleeve 179, previously referred to, and which may be integral with the housing section 152. The sheave is of hollow construction accommodating an annular winding 286 which is supported upon an annular bracket 287.

When the winding 286 is in its de-energized state, the clutch brake 283 is drawn clear of the sheave by the spider 282 so that rotary motion from the sheave is not transmitted to the rotor of the device. However, when the winding 286 is energized, the sheave is magnetized and draws into contact with it the annular plate 283 which transmits torque through the spider 282 to the flange 281 and thence to the shaft.

It is one of the features of the present construction that it is readily adaptable to the cantilever type mounting as shown in FIG. 29. In this figure corresponding numerals are used to indicate corresponding parts with addition of subscript a. Thus the construction includes a housing 150*a* formed of a first section 151*a* and a second section 152*a*, the section 151*a* being blind and without any outboard bearing. The rotor 200*a*, having vane pairs 261*a* and 262*a*, defining vanes 271*a*–274*a*, has a shaft 206*a* which is supported, instead, upon a single elongated anti-friction bearing 182*a*. The bearing is mounted in a sleeve 178*a* forming an integral part of the housing section 152*a*. The sleeve is, in turn, secured to a supporting base or bracket 280 (see also FIG. 30). A clamp 281 is provided in the sleeve for preventing relative rotation, and for axially positioning, the outer bearing race. An auxiliary sleeve 179*a* supports the clutch assembly 180*a*.

One difference between the cantilevered embodiment of FIG. 29 and the embodiments previously disclosed is that the rotor has but a single core element 237*a* holding its sectors together. However, it will be apparent to one skilled in the art that a second core may be provided at the left-hand end of the rotor for joining the sectors to provide added strength and to inhibit "flowering" or spreading of the sectors at high speed. Lack of the second core means that the vanes need not be captive in the rotor, and free accessibility is provided to a bolt, indicated at 283 which joins the sections of the shaft together.

A further difference between the embodiment of FIG. 29 and the preceding embodiments resides in the construction of the vane pairs 261*a*, 262*a* set forth in FIGS. 31 and 32. Both vane pairs are formed of a solid plate of metal or equivalent stable and strong material. The vane pair 261*a* has a narrow neck 275*a* at the center thereof and which is formed, at its center, with a small, doubly truncated, or flattened, ball 276*a*. The second vane pair 262*a* has a neck of wider dimension having a longitudinal slot 295 formed therein so as to define a pair of connectors 278*a*. The slot has a length sufficient to accommodate the width dimension of the first vane pair 261*a* and a width which is sufficient to accommodate the thickness of the first vane pair, enabling the latter to be inserted into the slot into a centered position in which the ball 276*a* lies between the connectors 278*a*. The connectors are formed with inwardly facing spherical recesses 277*a* which are dimensioned to receive the ball, so that when the first vane pair is twisted about its longitudinal axis, in the direction of the arrow in FIG. 31, the ball becomes captive in the recesses to provide the mutual centering effect achieved in the preceding embodiment. That is, with the vanes occupying 90 degree positions, the ball engagement provides a rockable joint between the vane pairs so that they hold one another mutually captive in the radial direction, permitting a running clearance to be established at the vane tips.

It will be understood that while the inlet and outlet ports have been omitted for simplicity, in the embodiment shown in FIG. 29, such ports are provided on each side of the device as disclosed in FIG. 21, with the port location being chosen in accordance with the function and pressure ratio just as in the case of the preceding embodiments.

In all of the embodiments discussed above the two vanes comprising a vane pair are rigid with one another. Where the mechanism is employed in a mode which applies a net edgewise pressure to each vane in a pair, with the pressures producing an additive torque about a central axis perpendicular to the plane of the vane pair, there is a tendency of the vanes to cock edgewise, as a pair, within the confines of the main cavity. This results in a reaction force at an outer corner of each vane as indicated at F in FIG. 25 which may tend to cause wear in this region. To counteract this each vane comprising a pair is articulated with respect to the other for lateral edgewise movement of the vanes independently of one another. This may be accomplished by pivoting each vane to its central connector.

Preferably, however, the central connector is formed as a parallelogram linkage to limit relative movement of the vanes with respect to one another to lateral translation. Such an arrangement is disclosed in FIG. 27 in which a parallelogram linkage 300 is shown formed of straps 301, 302, which correspond to straps 278 in FIG. 25, the strap 301 being connected to the respective vanes at laterally articulated joints 303, 304, while the strap 302 has articulated joints 305, 306. In the simplest embodiment of the invention the desired articulation at 303–306 may be achieved by use of clamping bolts 307, 308 which provide slight looseness with respect to the straps and by making the registering openings in the straps just slightly oversized. A similar two-strap parallelogram construction may be employed for the companion vane pair, and with spherical recesses therein, provided a "floating" ball is used as taught in our cross-referenced application Ser. No. 116,155. While the use of a parallelogram linkage at the central connector does not completely overcome the effect of the unbalanced pressure, it insures that the reaction force is radially distributed along the edge of the vane to the extent that wear is minimized.

What we claim is:

1. A rotary machine comprising, in combination, a housing having bearing means, stubshaft means journalled in the bearing means, the housing defining a disc-shaped main cavity having adjoining axial recesses, the main cavity being more particularly in the form of a doubly truncated sphere symmetrical about a vane axis which is canted with respect to the shaft axis and with the axial recesses thereof being defined by concave spherical surfaces concentrically opposed to one another, a rotor in the housing mounted on the stubshaft means, the rotor having a central spherical portion for mating with the concave spherical surfaces, the rotor including an integral Saturn-like ring of trapezoidal section symmetrical about the shaft axis, the ring extending to a position adjacent the peripheral wall of the main cavity dividing the cavity into first and second sides each of annular wedge shape having thick and thin portions arranged in complementary fashion, the rotor having diametrically extending slots aligned with the rotor axis to divide the rotor into sectors, the slots intersecting to create a hollow in the spherical portion of the rotor, the sectors being interconnected by cores spaced at the axial ends of the rotor, the stubshaft means extending axially outwardly from the cores for journalling in the bearing means, vane pairs in the slots, the vanes presenting a profile substantially corresponding to the profile of the truncated sphere to separate each side into successive chambers which vary cyclically in volume as the rotor rotates, the vanes having lateral edges lying in a cylindrical locus and having a thickness at least equal to $T \sin \alpha$ where T is the thickness of the main cavity and where $\alpha$ is the angle of the vane axis with respect to the shaft axis, each side having an inlet port and an outlet port in straddling relation to the thin portion thereof, the vanes having laterally projecting shoulders along their lateral edges formed to mate with the respective concave spherical surfaces in the housing, the vanes comprising each pair being interconnected in coplanar relation by a central connector, the central connectors being axially offset for crossing one another in the hollow of the rotor.

2. The combination as claimed in claim 1 in which the ports include arcuately distributed openings on the side walls of the truncated spherical cavity.

3. The combination as claimed in claim 1 in which the inlet and outlet ports are positioned so that the first side of the device serves as a compressor and the second side of the device serves as an expander, and a primary heat exchanger connected between the compressor outlet port and the expander inlet port to dissipate the heat of compression, the concave spherical surfaces having unlike radii so that equal masses of air are handled per revolution by the expander and compressor.

4. The combination as claimed in claim 1 in which the inlet and outlet ports are positioned so that each side of the device serves as a compressor, the inlet and outlet ports being connected respectively in parallel with one another.

5. The combination as claimed in claim 1 in which the housing is formed of two complementary sections having a parting plane which symmetrically bisects the main cavity along a plane perpendicular to the axis thereof, each section having an annular flange extending radially outwardly in a plane perpendicular to the vane axis, the flange having axially-extending bolt holes formed therein, the bolt holes being at equal radii and equally spaced in diametrically-related pairs so that the holes are in register when the sections are 180 degrees out of phase, and bolts in the holes, at least a distributed portion of the bolts being closely fitted in the holes which receive them.

6. The combination as claimed in claim 1 in which the housing is formed of two complementary sections having a parting plane which lies in the central transaxial plane of the rotor, being of corresponding shape and size, and means for securing the sections together 180 degrees out of phase with one another.

7. The combination as claimed in claim 1 in which the housing is formed of two complementary sections having a parting plane which bisects the main cavity perpendicularly to the vane axis, the sections being of corresponding shape and size, and means for securing the sections together 180 degrees out of phase with one another.

8. The combination as claimed in claim 1 in which the housing is formed of two complementary sections having a parting plane which bisects the main cavity perpendicularly to the vane axis, a narrow shoulder being provided on the shaft for engaging the bearing means and sufficient clearance being provided between the periphery of the ring and the peripheral wall of the main cavity to permit the shoulder on the shaft to be drawn clear of the bearing with straight axial motion followed by bodily rocking of the shaft thereby to permit assembly and removal of the rotor with respect to the main cavity of the housing notwithstanding the angle of cant of the main cavity.

9. The combination as claimed in claim 1 in which the housing is formed of two complementary sections having a parting plane, and a layer of thermal insulation at the parting plane for inhibiting passage of heat from one section to the other.

10. The combination as claimed in claim 1 in which the trapezoidal cross section of the ring is of isosceles profile having an included angle substantially equal to double the angle of cant thereby to establish a line of contact with the wall of the main cavity at 180 degree positions to define regions of zero thickness of the respective sides.

11. The combination as claimed in claim 1 in which the sectors of the Saturn-like ring of trapezoidal section are hollow and enclosed by flat end walls engaging the vanes, and vents in the respective outer portions of the hollows to insure ejection by centrifugal force of any lubricant or other liquid which may tend to collect therein.

12. The combination as claimed in claim 1 in which the sectors of the Saturn-like ring of trapezoidal section are hollow and enclosed by flat end walls engaging the vanes, the hollows being filled with rigidified plastic foam.

13. The combination as claimed in claim 1 in which the cores are integral with the sectors of the rotor.

14. The combination as claimed in claim 1 in which at least one of the cores is in the form of a cap secured to the sectors of the rotor for joining the sectors together.

15. The combination as claimed in claim 1 in which the rotor is formed of two cup-shaped pieces mated along a central parting line which is perpendicular to the rotor axis in opposed relation to form a central hollow with the slots and the hollow being occupied by interengaged vane pairs, the two pieces of the rotor being intimately secured to one another along the parting line to hold the vane pairs captive in the rotor.

16. The combination as claimed in claim 1 in which the rotor includes a layer of thermal insulation centrally positioned in the rotor and lying in a plane perpendicular to the rotor axis.

17. The combination as claimed in claim 1 in which the rotor ring is covered by a layer of thermal insulation.

18. The combination as claimed in claim 1 in which separate bearings are provided at the ends of the rotor, and lubricating means including a lubricant tube extending axially through the rotor for conducting lubricant to the bearings, the central connectors connecting the vane pairs being routed around the lubricant tube.

19. The combination as claimed in claim 1 in which the rotor has a single stubshaft supported in a single bearing in the housing thereby providing a cantilever type mounting for the rotor.

20. The combination as claimed in claim 1, at least one of the opposed pairs of vanes being integrally formed as a flat rigid plate.

21. The combination as claimed in claim 1 in which first and second opposed pairs of vanes are provided, each pair being integrally formed as a flat plate, the first one of the vane pairs having a narrow neck at the center thereof, the second vane pair having a neck of wider dimension with a longitudinal slot formed therein, the slot having a length and width sufficient to accommodate the width and thickness respectively of the first vane pair so that the latter may be inserted into the slot and rocked about its longitudinal axis through an angle of 90 degrees so that the vanes are engaged and lie in planes at right angles to one another for occupation of respective slots in the rotor.

22. The combination as claimed in claim 21 in which the narrow neck of the first vane pair is shaped in the form of a small doubly truncated ball and in which the walls of the slot of the second vane pair have opposed spherical recesses so that when the first vane pair is rocked about its longitudinal axis through 90 degrees ball surfaces thereon engage the spherical recesses to produce a rockable joint between the vane pairs providing mutual captivity in the radial direction.

23. The combination as claimed in claim 1 in which the central connectors are of narrow axial dimension as compared to the width of the vanes resulting in a dumbbell configuration of each vane pair.

24. The combination as claimed in claim 1, at least a portion of the connectors being separable from the associated vanes for assembly and disassembly of the vane pairs with respect to the rotor.

25. The combination as claimed in claim 1 in which the central connector of at least one of the pairs of vanes includes a pair of radially oriented straps, at least one of the straps having disengageable means at each end for securing the strap to the presented inner ends of the vanes.

26. The combination as claimed in claim 24 in which the central connector of at least one of the pairs of vanes is in the form of a pair of parallel strap members symmetrically spaced from the vane center line and with the ends of the strap members being articulated with respect to the vanes to form a parallelogram linkage for limited lateral edgewise movement of the vanes comprising a pair independently of one another thereby to avoid the tendency of the vanes to cock edgewise as a pair within the confines of the main cavity.

27. The combination as claimed in claim 1 in which the connectors are straight and extend radially between the vanes, the connectors of the respective vane pairs being symmetrically centered with respect to the vane surfaces yet axially offset for interfitting with one another.

28. The combination as claimed in claim 1 in which each vane has a radial passageway leading from the hollow in the rotor to the tip of the vane for establishing communication between the ends of the vanes thereby to balance end forces thereon.

29. A rotary machine comprising, in combination, a housing having a shaft bearing axially arranged on one side thereof, the housing defining a disc-shaped main cavity having adjoining axial recesses, the main cavity being more particularly in the form of a doubly truncated sphere symmetrical about a vane axis which is canted with respect to the bearing axis and with the axial recesses thereof being defined by concave spherical surfaces concentrically opposed to one another, a rotor in the housing having a shaft at one end thereof extending through the bearing, the rotor having a central spherical portion for mating with the concave spherical surfaces, the rotor including an integral Saturn-like ring of trapezoidal section symmetrical about the rotor axis, the ring extending to a position adjacent the peripheral wall of the main cavity dividing the cavity into first and second sides each of annular wedge shape having thick and thin portions arranged in complementary fashion, the rotor having diametrically extending slots aligned with the rotor axis to divide the rotor into sectors, the slots intersecting to create a hollow in the spherical portion of the rotor, the sectors being interconnected by a single core at the shaft end of the rotor and axially joined to the shaft to provide cantilevered support for the rotor, vane pairs in the slots, the vanes presenting a profile substantially corresponding to the profile of the truncated sphere to separate each side into successive chambers which vary cyclically in volume as the rotor rotates, the vanes having lateral edges lying in a cylindrical locus and having a thickness at least equal to $T \sin \alpha$ where T is the axial thickness of the main cavity and where $\alpha$ is the angle of the vane axis with respect to the rotor and bearing axis, each side having an inlet port and an outlet port in straddling relation to the thin portion thereof, the vanes having laterally projecting shoulders along their lateral edges formed to mate with the respective concave spherical surfaces in the housing to inhibit leakage inwardly along the vane edges, the vanes comprising each pair being interconnected in coplanar relation by a central connector, the central connectors being axially offset for crossing one another in the hollow of the rotor.

* * * * *